US006708009B2

(12) United States Patent
Fuwazaki et al.

(10) Patent No.: US 6,708,009 B2
(45) Date of Patent: Mar. 16, 2004

(54) IMAGE FORMING DEVICE HAVING PAPER DUST REMOVING UNITS

(75) Inventors: Takeshi Fuwazaki, Nagoya (JP); Makoto Hattori, Nagoya (JP); Kazushi Fukuta, Nagoya (JP)

(73) Assignee: Brother Kogyo Kabushiki Kaisha, Nagoya (JP)

( * ) Notice: Subject to any disclaimer, the term of this patent is extended or adjusted under 35 U.S.C. 154(b) by 0 days.

(21) Appl. No.: 10/238,066

(22) Filed: Sep. 10, 2002

(65) Prior Publication Data

US 2003/0049043 A1 Mar. 13, 2003

Related U.S. Application Data

(60) Continuation-in-part of application No. 09/852,746, filed on May 11, 2001, now Pat. No. 6,505,019, and a continuation-in-part of application No. 09/824,054, filed on Apr. 3, 2001, now abandoned, which is a continuation-in-part of application No. 09/817,170, filed on Mar. 27, 2001, now Pat. No. 6,415,119, which is a division of application No. 09/409,386, filed on Sep. 30, 1999, now Pat. No. 6,219,505.

(30) Foreign Application Priority Data

| | | |
|---|---|---|
| Sep. 30, 1998 | (JP) | 10-278033 |
| Sep. 30, 1998 | (JP) | 10-278034 |
| Jan. 12, 1999 | (JP) | 11-005276 |
| Jan. 18, 1999 | (JP) | 11-009266 |
| Feb. 8, 1999 | (JP) | 11-030531 |
| Mar. 16, 1999 | (JP) | 11-070020 |
| Sep. 10, 2001 | (JP) | P2001-274323 |
| Sep. 10, 2001 | (JP) | P2001-274325 |
| Mar. 12, 2002 | (JP) | P2002-067641 |
| Mar. 12, 2002 | (JP) | P2002-067642 |

(51) Int. Cl.[7] ..... G03G 21/00
(52) U.S. Cl. ..... 399/98; 15/256.5
(58) Field of Search ..... 399/98, 91; 15/1.51, 15/256.5, 256.51, 256.52

(56) References Cited

U.S. PATENT DOCUMENTS

| | | | | |
|---|---|---|---|---|
| 4,370,050 A | | 1/1983 | Matsui et al. | 399/99 |
| 4,750,018 A | | 6/1988 | Gooray et al. | 399/390 |
| 4,769,676 A | | 9/1988 | Mukai et al. | 399/150 |
| 4,878,657 A | * | 11/1989 | Ura et al. | 399/98 X |
| 5,436,700 A | | 7/1995 | Kikuchi et al. | 399/111 |

(List continued on next page.)

FOREIGN PATENT DOCUMENTS

| | | | |
|---|---|---|---|
| DE | 4011295 A1 | * | 10/1990 |
| EP | 1 016 612 A1 | | 7/2000 |

(List continued on next page.)

OTHER PUBLICATIONS

Hosoya, M. et al. "Cleanerless Laser Printing Using Monocomponent Nonmagnetic Developement System," *Academic Presentations in Electronics Photography*, vol. 30, No. 3, 1991.

*Primary Examiner*—S. Chen
(74) *Attorney, Agent, or Firm*—Oliff & Berridge, PLC

(57) ABSTRACT

An image forming device capable of sufficiently removing paper dusts on a sheet thereby providing high quality image. A sheet transport path 38 is defined between a sheet supply section 7 provided with a separation pad 13 and a sheet supply roller 12 and an image forming section 5. Along the sheet supply section 7, at least a first paper dust removing roller 9*b* having a width slightly greater than the width of the separation pad 13 and a second paper dust removing roller 10*b* having a width slightly greater than the sheet width are disposed. Paper dusts generated upon friction against the separation pad 13 are removed by the first paper dust removing roller 9*b*, and paper dusts spreading over entire surface of the sheet are removed by the second paper dust removing roller 10*b*.

58 Claims, 12 Drawing Sheets

U.S. PATENT DOCUMENTS

| | | | | |
|---|---|---|---|---|
| 5,497,224 | A | 3/1996 | Ishikawa et al. | 399/354 |
| 5,587,774 | A | 12/1996 | Nagahara et al. | 399/176 |
| 5,610,697 | A | 3/1997 | Arai | 399/149 |
| 5,659,869 | A | 8/1997 | Ohtsuka et al. | 399/333 |
| 5,701,559 | A | 12/1997 | Ootaka et al. | 399/149 |
| 5,740,498 | A | 4/1998 | Tsuchiya | 399/98 |
| 5,774,768 | A | 6/1998 | Hazama et al. | 399/170 |
| 6,219,505 | B1 | 4/2001 | Sato et al. | 399/98 |
| 6,385,414 | B1 | 5/2002 | Sato et al. | 399/98 |

FOREIGN PATENT DOCUMENTS

| | | | |
|---|---|---|---|
| JP | 59-049575 | | 3/1984 |
| JP | U-62-181973 | | 11/1987 |
| JP | 1-161279 | | 6/1989 |
| JP | 1-295289 | | 11/1989 |
| JP | 04-066442 | * | 3/1992 |
| JP | 4-089733 | | 3/1992 |
| JP | 4-129940 | | 4/1992 |
| JP | 4-216569 | | 8/1992 |
| JP | 5-150692 | | 6/1993 |
| JP | 05-188691 | * | 7/1993 |
| JP | 6-118842 | | 4/1994 |
| JP | 6-130800 | | 5/1994 |
| JP | 6-161169 | | 6/1994 |
| JP | 6-332345 | | 12/1994 |
| JP | 08-073072 | * | 3/1996 |
| JP | B2-2619424 | | 3/1997 |
| JP | 10-109774 | * | 4/1998 |
| JP | 10-203672 | * | 8/1998 |
| JP | 10-231033 | * | 9/1998 |
| JP | 11-190963 | * | 7/1999 |
| JP | 11-208917 | * | 8/1999 |

* cited by examiner

IMAGE FORMING DEVICE HAVING PAPER DUST REMOVING UNITS

CROSS REFERENCE TO RELATED APPLICATION

This is a Continuation-in-Part of application Ser. No. 09/852,746 filed May 11, 2001, now U.S. Pat. No. 6,505,019, which in turn is a Continuation-in-Part of application Ser. No. 09/817,170 filed Mar. 27, 2001, now U.S. Pat. No. 6,415,119, and a Continuation-in Part of application Ser. No. 09/824,054 filed Apr. 3, 2001 now abandoned, which in turn is a Divisional application of Ser. No. 09/409,386 filed Sep. 30, 1999, now patented as U.S. Pat. No. 6,219,505

BACKGROUND OF THE INVENTION

The present invention relates to an image forming device such as a laser printer.

An image forming device such as a laser printer generally includes a sheet supply section for supplying sheets and an image forming section for forming an image on a sheet supplied from the sheet supply section. The sheet supply section generally includes a sheet supply tray on which a stack of sheets is mounted, a sheet supply roller positioned near one end and above the sheet supply tray, and a separation pad positioned in confrontation therewith. Upon rotation of the sheet supply roller, an uppermost sheet on the sheet supply tray is nipped between the sheet supply roller and the separation pad and is delivered to the image forming section.

The image forming section includes a photosensitive drum, a charger, a scanner device, a developing roller and an image transfer roller those positioned around the photosensitive drum and in order in a rotating direction thereof. In accordance with the rotation of the photosensitive drum, a surface of the photosensitive drum is uniformly charged by the charger, and then, the surface is exposed to laser beam emitted from the scanner device and scanned at high speed in accordance with image data to form an electrostatic latent image on the surface. Then, toners carried on the developing roller are supplied to the surface of the photosensitive drum by the rotation of the developing roller to form a visible toner image on the surface of the photosensitive drum corresponding to the electrostatic latent image. The toner image carried on the surface of the photosensitive drum is then transferred onto the sheet supplied from the sheet supply section when the sheet passes between the photosensitive drum and the image transfer roller. Thus, a toner image can be formed on the sheet.

In the image forming device, paper dusts may be inevitably generated on the sheet due to the friction against the separation pad because each sheet is supplied while being nipped between the sheet supply roller and the separation pad. Thus, image quality may be lowered, if such paper dusts are mixed with the toners at the image forming section.

To avoid this problem, known is a paper dust removing roller disposed upstream of the sheet supply roller. The paper dust removing roller has a width approximately the same as that of the separation pad in order to remove the paper dust on the sheet before the sheet reaches the image forming section. However, paper dusts have already inherently existed over the entire surface of the sheet due to sheet cutting. Therefore, it would be difficult to remove the inherent paper dusts only by such paper dust removing roller having the width the same as that of the separation pad.

Both inherently generated paper dusts as well as the paper dusts generated due to the friction with the separation pad may be removed by a paper dust removing roller as far as the paper dust removing roller has a width the same as the sheet width. However, amount of the paper dust generated by the friction against the separation pad is greater than the inherently generated amount. Therefore, even if the removal of the paper dust is intended by such paper dust removing roller having the paper width, paper dust cannot be removed uniformly, but removal unevenness occurs between an area where paper dusts were generated due to the friction against the separation pad and an area where the paper dusts have been inherently generated. Thus, uniform removal of the paper dusts cannot be achieved.

Further, a plurality of paper dust removing rollers can be provided along a sheet supply path in order to remove the paper dust on the sheet supplied from the sheet supply section. However, a paper dust transport mechanism and a paper dust accumulator are provided for every paper dust removing roller for transporting and accumulating paper dusts removed by each paper dust removing roller. Therefore, an entire structure becomes complicated, and mechanical components and parts are increased, which renders a resultant image forming device bulky and costly.

SUMMARY OF THE INVENTION

Therefore, it is an object of the present invention to overcome the above-described drawbacks, and to provide an image forming device capable of efficiently removing paper dust from the sheet and providing high quality image.

Another object of invention is to provide such image forming device with a simplified arrangement and capable of reducing numbers of mechanical parts, yet performing a sufficient paper dust removal by a plurality of paper dust removing units.

Still another object of the present invention is to provide such image forming device capable of stably transporting, by way of the paper dust transport means, the paper dusts removed by the paper dust removing unit to assure a sufficient falling distance between the paper dust removing unit and the paper dust transport means in order to unit and the paper dust transport means in order to provide a sufficient paper dust accumulation space below the paper dust removing unit.

Still another object of the present invention is to provide such image forming device capable of preventing paper dusts absorbed by the paper dust removing unit from again returning back to a sheet transport path in order to avoid mixture of the paper dusts with developing agent such as toners in a image forming operation performed at downstream of the paper dust removing unit.

These and other objects of the present invention will be attained by providing an image forming device for forming an image on an image recording medium, the device including a sheet supply section, an image forming section, a sheet transport path, and an improved at least two paper dust removing units. The sheet supply section includes a sheet supply roller and a separation pad for nippingly supplying each image recording medium therebetween. The image forming section is adapted for forming an image on the image recording medium supplied from the sheet supply section. The sheet transport path extends from the sheet supply section to the image forming section and defines a sheet feeding direction. The at least two paper dust removing units include a first paper dust removing unit and a second paper dust removing unit. The first paper dust removing unit is disposed at a position beside the sheet transport path and is contactable with the image recording medium for removing paper dusts from the image recording medium running in the sheet transport path toward the image forming section. The second paper dust removing unit is disposed at a position beside the sheet transport path and different from the position of the first paper dust removing unit with respect to the sheet feeding direction and also is contactable with the image recording medium for also removing paper dusts from the image recording medium running in the sheet transport path toward the image forming section.

In one preferred embodiment, the first paper dust removing unit includes a first paper dust removing member in contact with the image recording medium during its travel in the sheet transport path, and the second paper dust removing unit includes a second paper dust removing member in contact with the image recording medium during its travel in the sheet transport path. The first paper dust removing member has a width perpendicular to the sheet feeding direction greater than the width of the separation pad, and the second paper dust removing unit has a width perpendicular to the sheet feeding direction greater than the width of the image recording medium. The width of the first paper dust removing member is smaller than the width of the image recording medium. As such, the first paper dust removing member can remove paper dusts from the image recording medium at least in an area corresponding to the width of the separation pad. Also, the second paper dust removing unit can remove paper dusts in overall surface of the image recording medium.

The image forming device further provides a paper dust accumulating section for congregately accumulating therein paper dusts removed by at least two paper dust removing units from the image recording mediums and then released from the respective paper dust removing units.

In other aspect of the invention, there is provided an image forming device including the image forming section, a sheet transport path extending to the image forming section, a paper dust removing member, a scraping member, and a reverse transport preventive member. The paper dust removing member is positioned in confrontation with the sheet transport path and contactable with the image recording medium passing therethrough for removing paper dusts from the image recording medium. The scraping member is in contact with the paper dust removing member for scraping off the paper dusts from the paper dust removing member. The paper dust removing member is supported rotatably in a normal direction equivalent to the sheet feeding direction and a reverse direction opposite to the normal direction. The reverse transport preventive member is disposed between a first contact position defined between the paper dust removing member and the image recording medium and a second contact position defined between the paper dust removing member and the scraping member for preventing the paper dusts released from the scraping member from being transported back toward the sheet transport path during the reverse rotation of the paper dust removing member.

In still another aspect of the invention, there is provided an image forming device including the image forming section, a paper dust removing unit for removing paper dusts from the image recording medium to be supplied to the image forming section, a paper dust transport unit, and a regulation wall. The paper dust transport unit is disposed lower than the first paper dust removing unit for transporting in a paper dust transporting direction the paper dusts falling down from the paper dust removing unit. The regulation wall is disposed at a part of the paper dust transport unit for regulating a flow of the paper dusts.

BRIEF DESCRIPTION OF THE DRAWINGS

In the drawings:

FIG. 3(*b*) is a front view showing a second paper dust removing roller in a second transport portion as viewed from an arrow A of FIG. 2;

FIG. 3(*c*) is a cross-sectional view showing a first paper dust removing roller according to the first embodiment of the present invention;

FIG. 3(*d*) is a plan view showing a pad member according to the first embodiment;

FIG. 13(*b*) is a front view showing the power transmission mechanism of FIG. 13(*a*)

DETAILED DESCRIPTION OF THE PREFERRED EMBODIMENTS

An image forming device according to a first embodiment of the present invention will be described with reference to FIGS. 1 through 8 in which an electro-photographic type laser printer 1 is shown.

(1) General Arrangement and Image Forming Operation

Figure 1:
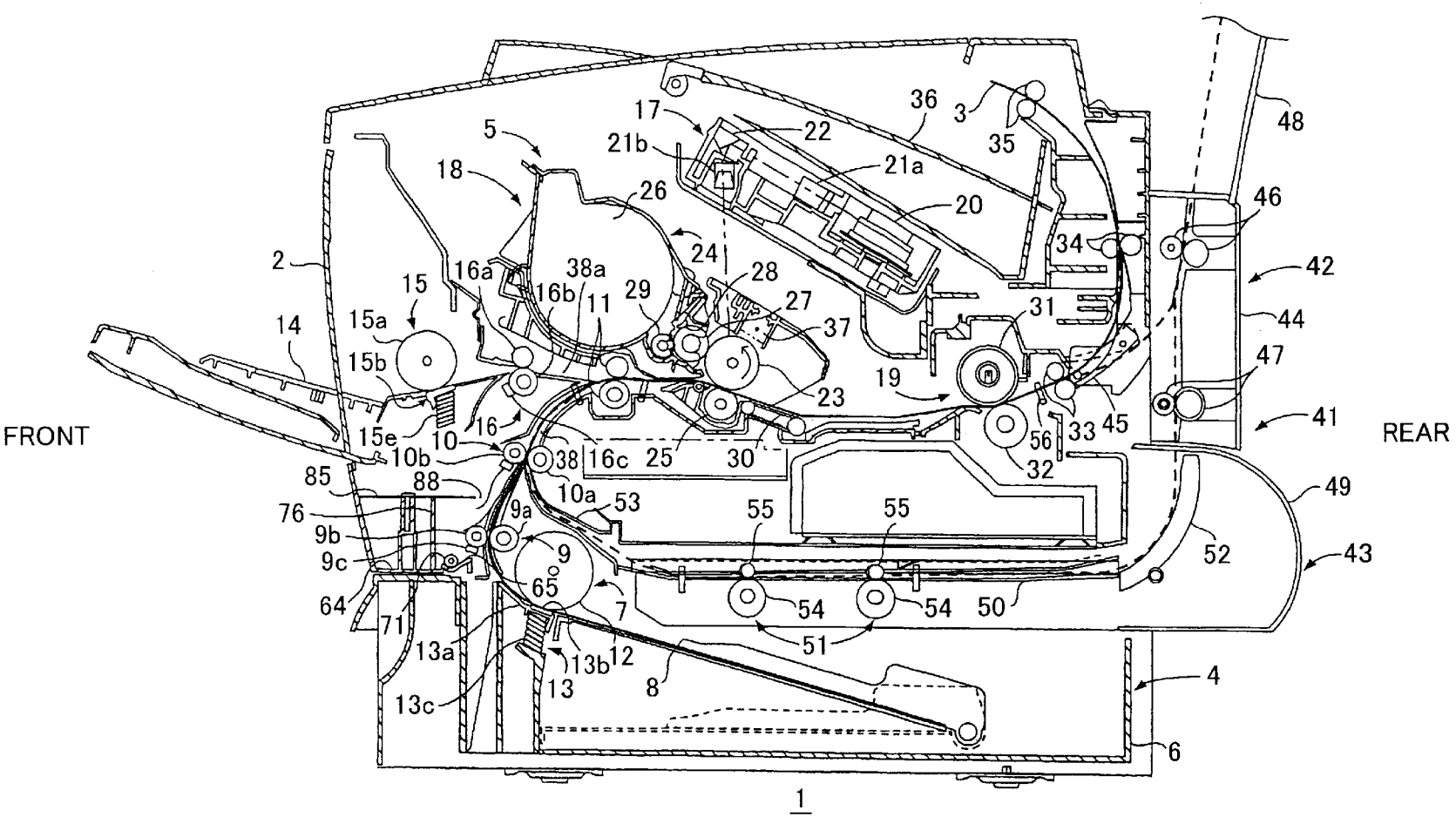
FIG. 1 is a side cross-sectional view showing an essential portion of a laser printer according to one embodiment of the present invention.

As shown in FIG. 1, the printer 1 includes a main casing 2, a feeder portion 4 for feeding a sheet 3 as an image recording medium, and an image forming section 5 for forming an image on the fed sheet 3. The feeder portion 4 and the image forming section 5 are installed in the casing 2.

The feeder portion 4 includes a sheet supply tray 6 positioned on a bottom of the main casing 2 and detachable therefrom, a sheet supply section 7 disposed at one side of the sheet supply tray 6, a sheet mount plate 8 disposed in the sheet supply tray 6, a first transport portion 9 (a first paper dust removing unit), a second transport portions 10 (a second paper dust removing unit), and a register roller 11. The first and second transport portions 9 and 10 are positioned at a downstream side of the sheet supply section 7 in a sheet feeding direction. The register roller 11 is positioned downstream of the first and second transport portions 9,10.

The sheet supply tray 6 is of a box shape with an upper open construction so as to accommodate therein a stack of sheets 3. The sheet supply tray 6 is slidable with respect to the bottom of the main casing 2, so that the tray 6 is detachable from the casing 2.

Figure 2:
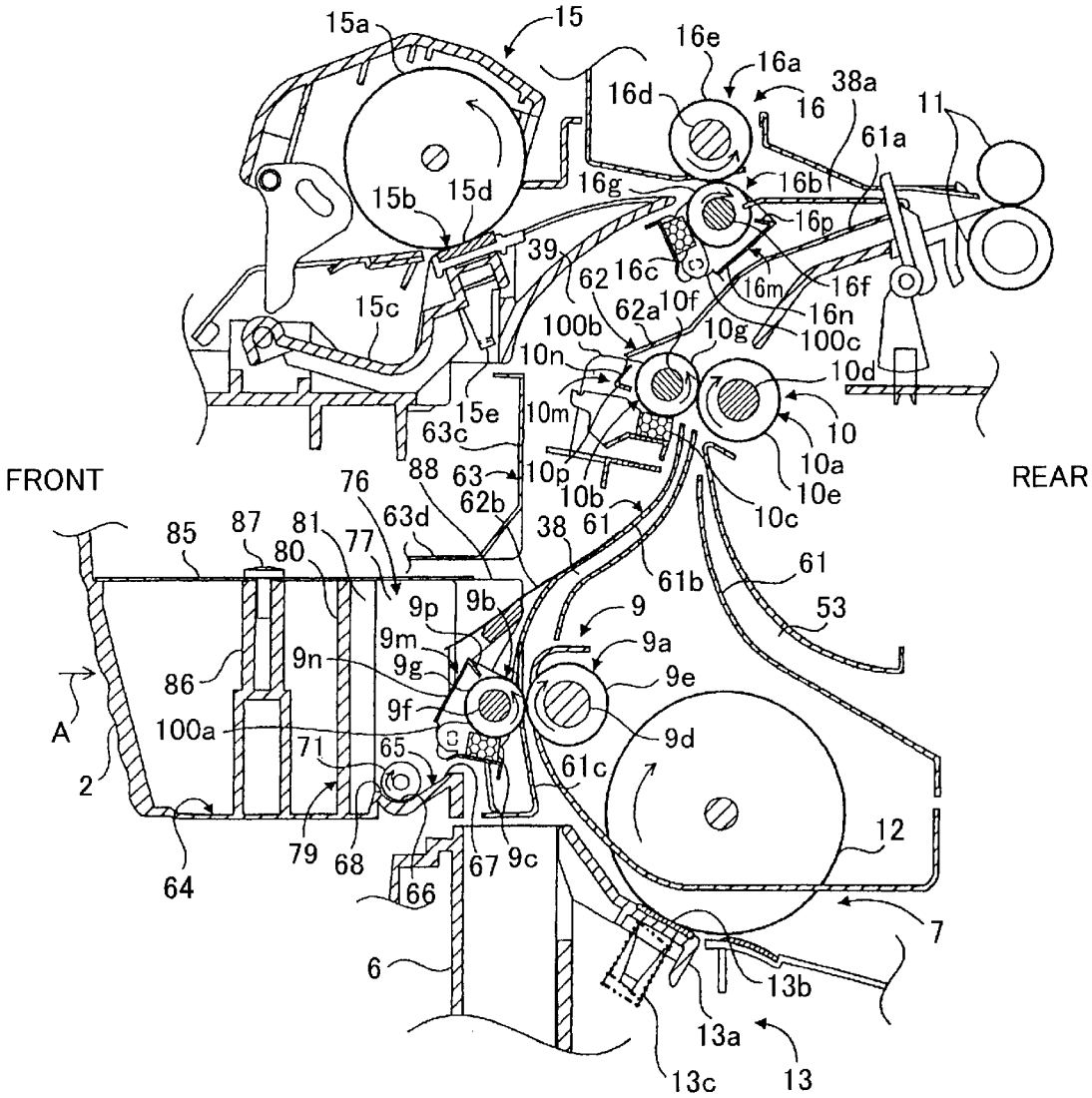
FIG. 2 is an enlarged cross-sectional view particularly showing a sheet transport path in the laser printer of FIG. 1.
Figure 3A:
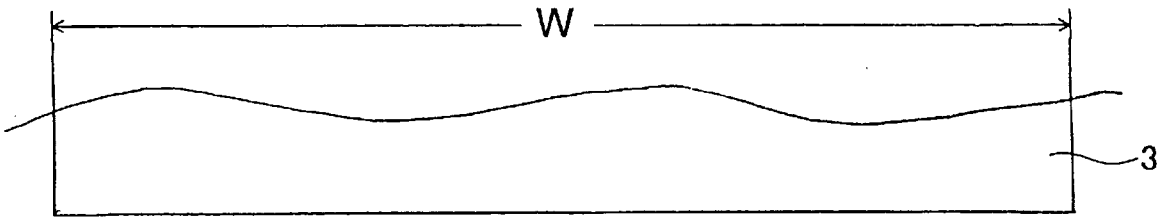
FIG. 3(*a*) is a plan view of a sheet.
Figure 3B:
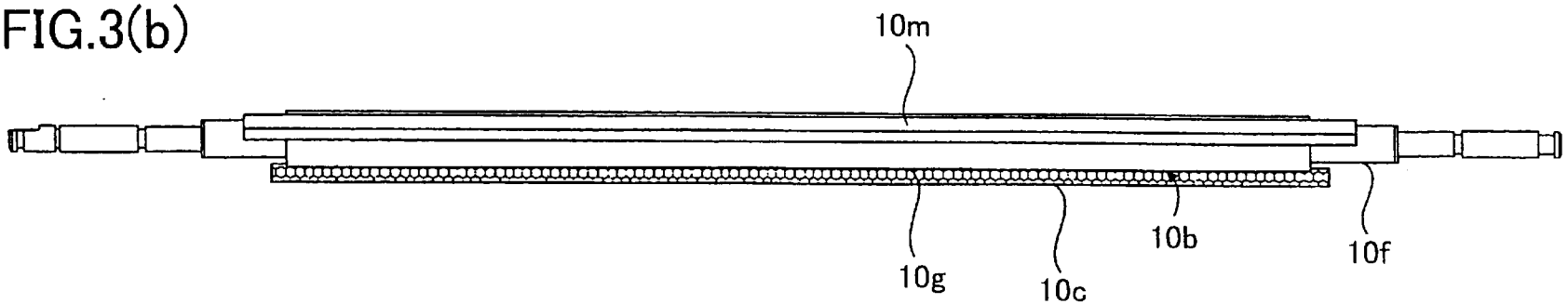
Figure 3C:
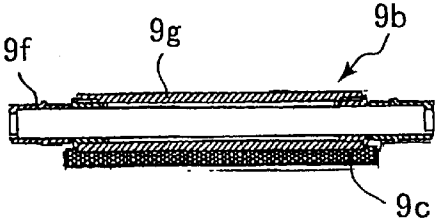
Figure 3D:
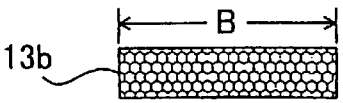

The sheet supply section 7 includes a sheet supply roller 12 and a separation pad 13 in confrontation therewith. As shown in FIG. 2, the separation pad 13 includes a support frame 13*a,* a pad member 13*b,* and a spring 13*c*.

The support frame 13*a* has generally L-shape in cross-section including a flat member positioned immediately below the sheet supply roller 12 and a support member extending downwardly from one side edge of the flat member and bent at a right angle with respect to the flat member. A lower end portion of the support member is pivotally connected to the main casing 2. The pad member 13*b* is embedded in one surface of the flat member to confront with the sheet supply roller 12. The flat member has an opposite surface to which the spring 13*c* is seated for urging the pad member 13*b* toward the sheet supply roller 12.

The pad member 13*b* has a generally rectangular shape and is formed of an elastic material such as a polyurethane rubber. As shown in FIGS. 3(*a*) and 3(*d*), the pad member 13*b* has a width B in a direction perpendicular to the sheet feed direction smaller than a width W of the sheet, the width W being a maximum width of the sheet undergoing printing by the laser printer 1. The pad member 13*b* is in contact with at least a widthwise center portion of the sheet 3 for the sheet supply.

A sheet mount plate 8 is adapted for mounting thereon the sheet stack. The sheet mount plate 8 has a rear end pivotally connected to the sheet supply tray 6 and a front free end movable in a vertical direction. A compression spring (not shown) is provided below the sheet mount plate 8 for normally urging the sheet mount plate 8 upwardly. Therefore, if sheet stack amount on the sheet mount plate 8 is increased, the free end of the sheet mount plate 8 is pivotally moved downwardly about the rear pivot axis against the biasing force of the compression spring (not shown). An uppermost sheet 3 on the sheet stack on the sheet mount plate 8 is urged toward the sheet supply roller 12 because of the biasing force of the compression spring associated with the sheet mount plate 8. Upon rotation of the sheet supply roller 12, a leading end portion of the uppermost sheet is nipped between the sheet supply roller 12 and the pad member 13*b*. In this manner each uppermost sheet is separated from the sheet stack and is delivered.

Incidentally, the sheet supply section 7 employs the friction/separation system and provides the following relationship in the friction force at the sheet supply timing. That is, frictional force between the sheet supply roller 12 and the sheet 3 is greater than the frictional force between the pad member 13*b* and the sheet 3, and the latter frictional force is greater than the frictional force between overlapping sheets.

The sheet is delivered to the register roller 11 through a sheet transport path 38 between the sheet supply section 7 and the image forming section 5 by way of first and second transport portions 9 and 10 described later. The register roller 11 includes a pair of rollers for correcting diagonal feeding of the sheet 3 so as to feed the sheet 3 in a correct orientation to the image forming section 5.

The image forming section 5 includes a scanner portion 17, a process unit 18, and a fixing portion 19. The scanner portion 17 is disposed at an upper interior portion of the main casing 2, and includes a laser emitting portion (not shown), a rotatably driven polygon mirror 20, lenses 21*a,* 21*b,* and a reflection mirror 22. The laser beam according to image data is emitted from the laser emitting portion and is scanningly irradiated at high speed onto a surface of the photosensitive drum 23 of the process unit 18 through an optical path as shown by a dotted chain line in FIG. 1 defined by the polygon mirror 20, the lenses 21*a,* the reflection mirror 22 and the lens 21*b*.

The process unit 18 is disposed below the scanner portion 17 and is provided detachable from the main casing 2. The process unit 18 includes a drum cartridge and a developing cartridge 24. The drum cartridge houses therein the photosensitive drum 23 serving as a photosensitive member, an image transfer roller 25, and a scorotoron charger 37. The developing cartridge 24 is detachable from the drum cartridge and houses therein a toner hopper 26. the developing roller 27, a toner layer thickness regulation blade 28, and a toner supply roller 29.

In the toner hopper 26, positively chargeable non-magnetic single component type polymerized toners are filled as the developing agents. Such toners are supplied to the developing roller 27 by the toner supply roller 29, and are carried on the developing roller 27 as a constant thin thickness toner layer because of frictional sliding relation with the toner layer thickness regulation blade 28. On the other hand, the photosensitive drum 23 is rotatably disposed in confronting relation to the developing roller 27. The photosensitive drum 23 includes a drum body which is grounded, and a positively chargeable photosensitive layer made from polycarbonate formed over the drum body.

In accordance with the rotation of the photosensitive drum 23 in a direction indicated by an arrow, the surface of the drum 23 is uniformly charged with positive polarity by means of the scorotoron charger 37, and is subjected to exposure to laser beam scanningly emitted from the scanner portion 17 at high speed according to the print data, whereupon electrostatic latent image is formed on the photosensitive surface. Then, in accordance with the rotation of the developing roller 27, the toner carried on the developing roller 27 and charged with positive polarity is supplied to the exposed part of the photosensitive drum 23, the potential level of the exposed part being lower than that of the remaining part of the photosensitive drum surface uniformly positively charged. Thus, a visible toner image is formed on the photosensitive drum 23 to complete a reverse image developing.

The transfer roller 25 is positioned inmediately below the photosensitive drum 23. The transfer roller 25 includes a rotation shaft made of a metal and connected to an electrical power source, and an electrically conductive rubber layer formed over the rotation shaft. A predetermined transfer bias voltage is applied to the rotation shaft for the toner transfer from the photosensitive drum 23 to the sheet 3. When the sheet 3 passes between the photosensitive drum 23 and the transfer roller 25, the visible toner image is transferred onto the sheet 3, which is then delivered to the fixing portion 19 through a transport belt 30.

The fixing unit 19 is positioned beside the process unit 18 and downstream side of the process unit 18. The fixing unit 19 includes a heat roller 31, a pressure roller 32 in pressure contact with the heat roller 31, and a feed roller 33 positioned downstream of the heat roller 31 and the pressure roller 32. The heat roller 31 is made from a metal and is provided with a halogen lamp as a heat source. The toner image transferred onto the sheet 3 at the process unit 18 is thermally fixed to the sheet 3 when the image carrying sheet passes through the heat roller 31 and the pressure roller 32. The sheet 3 is then delivered to a downstream side feed roller 34, a discharge roller 35 disposed in the main casing 2 by way of the feed roller 33. The sheet 3 fed by the downstream side feed roller 34 is discharged onto a discharge tray 36 by way of the discharge roller 35.

In the laser printer 1, residual toners remaining on the surface of the photosensitive drum after the toner transfer to the sheet 3 by the transfer drum 25 are collected by the developing roller 27. This toner collection manner is so called a cleaner-less system in which a blade for wiping out the residual toner and a residual toner container can be dispensed with, to simplify an overall arrangement of the image forming device.

A sheet re-circulation unit 41 is provided for forming images on both surfaces of the sheet 3. The re-circulation unit 41 includes a sheet reverse section 42 and a re-circulation tray 43 integrally therewith. The re-circulation unit 41 is positioned at a rear wall of the main casing 2 in such a manner that the sheet reverse section 42 is attached beside the rear wall, and the re-circulation tray 43 is detachably insertedly assembled into the rear wall at a position above the feeder section 4.

The sheet reverse section 42 has a casing 44 having a rectangular cross-section and attached to the rear wall of the main casing 2. In the casing 44, a flapper 45, reverse rollers 46 and re-circulation rollers 47 are provided. Further, a reverse guide plate 48 extends upwardly from an upper end portion of the casing 44. The flapper 45 is pivotably provided at the rear portion of the main casing 2 and is positioned at a downstream side of the feed roller 33. The flapper 45 is pivotally moved upon energization or de-energization of a solenoid (not shown) for switching a feeding direction of the one-sided image carrying sheet 3 fed by the feed roller 33 either to the downstream feed roller 34 as shown by a solid line or to the reverse rollers 46 as shown by a broken line.

The reverse rollers 46 include a pair of rollers and are positioned downstream of the flapper 45 and at an upper portion of the casing 44. Rotational direction of the reverse rollers is changeable in both normal and reverse directions. The reverse rollers 46 are first rotated in the normal direction to direct the sheet 3 toward the reverse guide plate 48, and then rotated in the reverse direction to transport the sheet 3 in the reverse direction.

The re-circulation rollers 47 are positioned downstream of the reverse rollers 46 and are positioned immediately therebelow in the casing 44. The re-circulation rollers 47 include a pair of rollers to direct the sheet 3 reversely driven by the reverse rollers 46 toward the re-circulation tray 43. The reverse guide plate 48 is constituted by a plate like member extending upwardly from the upper end of the casing 44 for guiding travel of the sheet 3 fed by the reverse rollers 46.

For printing an image on a back surface of the sheet 3 whose front surface has been formed with an image, in the sheet reverse section 42, the flapper 45 is switched to a position allowing the sheet 3 to be fed toward the reverse roller pair 46. Thus, the sheet 3 whose front surface has been formed with an image is received in the sheet reverse section 42. After the sheet 3 reaches the reverse roller 46, the reverse roller 46 is rotated in a normal direction for temporarily discharging the paper upwardly along the reverse guide plate 48. When a major part of the sheet 3 is fed out of the casing 44 and a trailing end portion of the sheet 3 is nipped between the reverse roller pair 46, the normal rotation of the reverse roller pair 46 is stopped. Then, the reverse roller pair 46 are reversely rotated to feed the sheet 3 downwardly toward the re-circulation roller pair 47. A sheet sensor 56 is provided downstream of the fixing portion 19 for detecting the sheet 3. A reverse timing for changing the rotating direction of the reverse roller 46 from the normal rotation to the reverse rotation is controlled such that the reverse timing occurs after elapse of a predetermined period starting from a detection timing at which the sheet sensor 56 detects a trailing edge of the sheet 3. Further, the flapper 45 is switched to its original posture, i.e., a posture allowing the sheet to be fed to the downstream feed roller 34 from the feed roller 33 upon completion of feeding of the sheet to the reverse roller 46. Then, the sheet 3 reversely fed by the re-circulation roller pair 47 is delivered to the re-circulation tray 43 by the re-circulation roller pair 47.

The re-circulation tray 43 has a sheet receiving portion 49, a tray 50 and diagonal feed rollers 51. The sheet receiving portion 49 is externally attached to the main casing 2 at a position below the sheet reverse section 42, and has an arcuate sheet guide member 52. The sheet 2 substantially vertically downwardly oriented from the re-circulation roller pair 47 can be oriented in a substantially horizontal direction along the curvature of the sheet guide member 52 toward the tray 50.

The tray 50 has a rectangular plate-like shape, and is oriented in a horizontal direction above the sheet tray 6. An upstream end of the tray 50 is connected to the sheet guide member 52, and a downstream end of the tray 50 is connected to a re-circulation path guide 53 provided along the sheet transport path 38 in order to guide the sheet 3 from the tray 50 to the second transport portion 10.

At a sheet path on the tray 50, two diagonally feed rollers 51, 51 are positioned spaced away from each other in the sheet feeding direction. These diagonally feed rollers 51, 51 are adapted to feed the sheet in a direction for permitting the sheet to be in abutment with a reference plate (not shown). The reference plate is positioned at one widthwise edge area of the tray 50. Each diagonally feed roller 51 includes a diagonal feed drive roller 54 whose rotation axis extends substantially perpendicular to the sheet feeding direction, and a diagonal feed driven roller 55 in nipping relation to the drive roller 54. A rotation axis of the driven roller 55 extends in a direction displacing from the direction perpendicular to the sheet feeding direction, but extends in a slanting direction for allowing the sheet to be brought into abutment with the reference plate.

The sheet 3 delivered from the sheet receiving portion 49 to the tray 50 moves toward the image forming section 5, with the sheet having been turned upside down, through the re-circulation path guide 53 while one widthwise edge of the sheet is in slidingly abutting relation to the reference plate by the driving of the diagonally feed rollers 51. At the image forming section 5, the back surface of the sheet 3 is in confrontation with the photosensitive drum 23 for transferring a toner image to the back surface from the photosensitive drum 23. The toner image is then fixed at the fixing portion 19, and is then discharged onto the discharge tray 36.

(2) Paper Dust Removal at Sheet Path

In the laser printer 1, as shown in FIG. 2, the first and second transport portions 9 and 10 are disposed at the sheet transport path 38 for efficiently removing paper dusts spreading over the entire surface of the sheet 3 accompanied by sheet cutting for providing cut sheets or generated due to friction force occurring between the pad member 13*b* and the sheet supply roller 12 at the paper supply section 7.

The first transport portion 9 is positioned at a frontal side of the sheet transport path 38 and downstream of the sheet supply roller 12 of the sheet supply section 7 with a predetermined space therefrom. Further, the first transport portion 9 is positioned upstream of a joining portion between the sheet transport path 38 and a downstream end of the re-circulation path guide 53. The first transport portion 9 includes a first transport roller 9*a* for transporting the sheet 3, a first paper dust removing roller 9*b* and positioned in opposition to the first transport roller 9*a* with respect to the sheet transport path 38, a first sponge member 9*c* serving as a first scraper disposed immediately below the first paper dust removing roller 9*b*, and first reverse transport preventive member 9*m* for preventing the paper dust from being transported from the first sponge member 9*c* to the sheet transport path 38.

The first transport roller 9*a* is positioned inwardly of a curvature of the sheet transport path 38, and includes a metallic roller shaft 9*d* and a rubber layer 9*e* formed thereover. The roller shaft 9*d* is rotatably supported by the main casing 2. The first transport roller 9*a* is drivingly rotatable in a direction indicated by an arrow, (clockwise direction in FIG. 1) through a power transmission from a motor (not shown). That is, a region of the first transport roller 9*a* confronting the sheet transport path 38 is rotated in the normal direction, i.e., in the sheet feeding direction.

The first paper dust removing roller 9*b* is disposed outwardly of the curvature of the sheet transport path 38, and includes a metallic roller shaft 9*f* and a rubber layer 9*g* having easily chargeable surface. The rubber layer is made from a fluororesin, or rubber whose outer surface is formed with fluorine coating. The first paper dust removing roller 9*b* is shown in FIG. 3(*c*). The first paper dust removing roller 9*b* is so positioned as to brought into contact with the sheet surface (to be in contact with the photosensitive drum) which has been contacted with the pad member 13*b*, and to align with a longitudinally center portion of the first transport roller 9*a*, the center portion being in confrontation with the separation pad 13. The width (axial length) of the rubber layer roller 9*g* is smaller than a width of a roller 10*g* of a second paper dust removing roller 10*b* described later, and slightly greater than the width B of the pad member 13*b* as shown in FIGS. 3(*c*) and 3(*d*).

The main casing 2 has a support member 100*a*, and the first paper dust removing roller 9*b* has a roller shaft 9*f* roatably supported by the support member 100*a* as shown in FIG. 2. The first paper dust removing roller 9*b* is driven by the first transport roller 9*a* and rotated in a direction indicated by an arrow (counterclockwise direction in FIG. 1). That is, a region of the first paper dust removing roller 9*b* confronting the sheet transport path 38 is rotated in the normal direction, i.e., in the sheet feeding direction. The first transport roller 9*a* and the first paper dust removing roller 9*b* nip the sheet 3 therebetween for transporting the sheet 3 while removing the paper dusts from the sheet 3. Incidentally, the first transport roller 9*a* and the first paper dust removing roller 9*b* can be reversely rotated for removing a jamming sheet.

The first sponge member 9*c* is formed from a material which can easily charge the first paper dust removing roller 9*b*. Typical material is urethane foam. The first sponge member 9*c* is positioned immediately below the first paper dust removing roller 9*b* and in pressure contact therewith at a position opposite to the sheet transport path 38 with respect to the paper dust removing roller 9*b* so as to scrape off the paper dust from the paper dust removing roller 9*b*. The first sponge member 9*c* is in sliding contact with the first paper dust removing roller 9*b* to frictionally charge the surface of the first paper dust removing roller 9*b*. A width of the first sponge member 9*c* is slightly greater than the width of the roller 9*g* of the first paper dust removing roller 9*b* as shown in FIG. 3(*c*).

Figure 4:
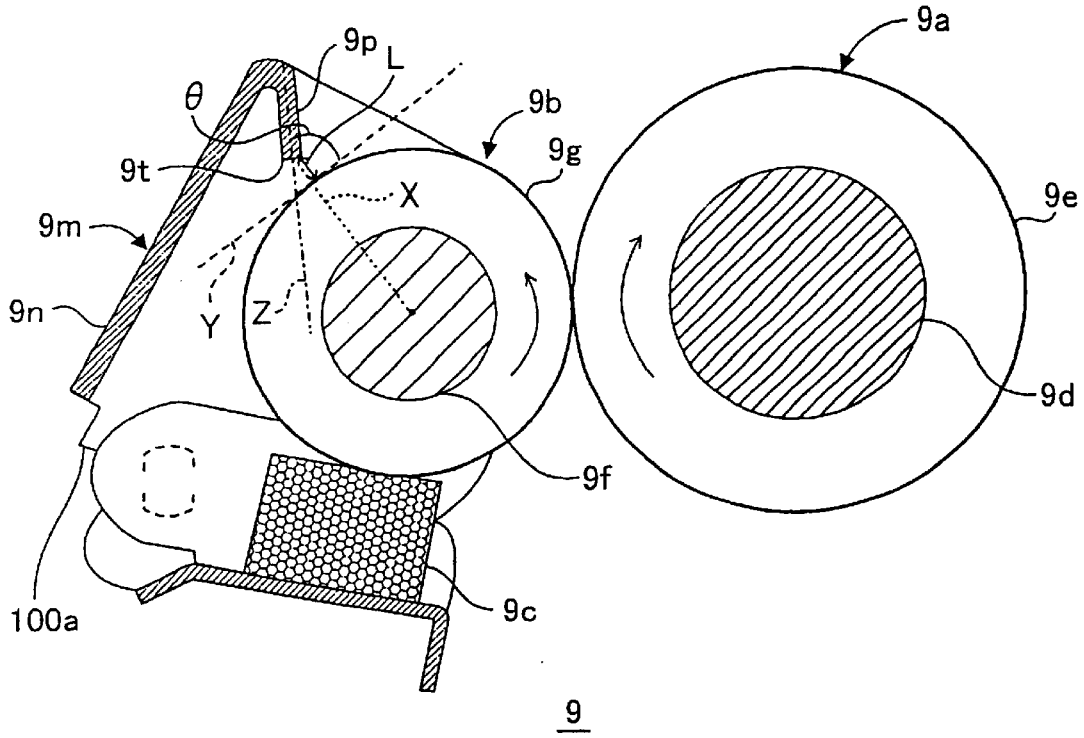
FIG. 4 is an enlarged cross-sectional view showing a first transport portion of the laser printer of FIG. 1.
Figure 6:
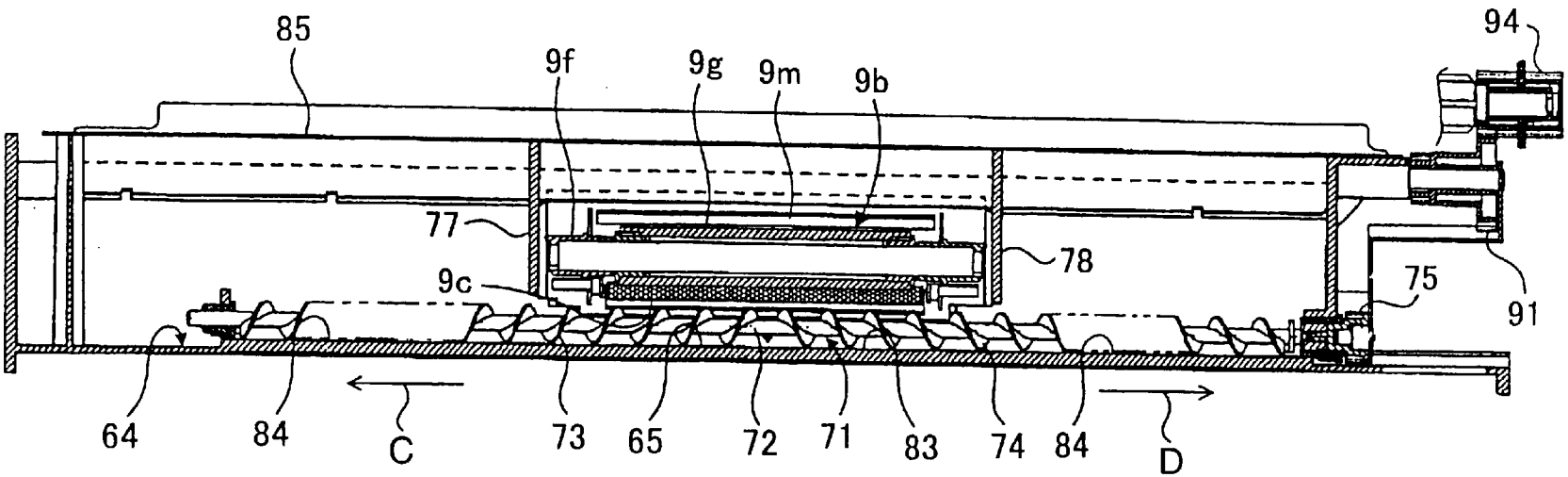
FIG. 6 is a front view partially in cross-section showing a first paper dust removing roller, a regulation wall and an auger member in the laser printer of FIG. 1.

As shown in FIG. 2, the first reverse transportation preventive member 9*m* is disposed downstream of a contacting position between the first paper dust removing roller 9*b* and the sheet 3 in the normal rotating direction of the roller 9*b*, and upstream of a contacting position between the first paper dust removing roller 9*b* and the first sponge member 9*c* in the normal rotating direction of the roller 9*b*. The first reverse transportation preventive member 9*m* extends in parallel with the axial direction of the first paper dust removing roller 9*b* and confronts the roller 9*b* with a predetermined space. As best shown in FIG. 4, the first reverse transportation preventive member 9*m* is L-shape in cross-section having a base portion 9*n* and a tip portion 9*p* bent from the base portion 9*n*. The first reverse transportation preventive member 9*m* is provided integrally with the support member 10*a* of the main casing 2 as a part of the support member. As shown in FIG. 6, a width of the first reverse transportation preventive member 9*m* is greater than the widths of the first paper dust removing roller 9*b* and the first sponge member 9*c*.

As shown in FIGS. 2 and 4, the base portion 9*n* is positioned opposite to the sheet transport path 38 with respect to the first paper dust removing roller 9*b* and slantingly extends in generally vertical direction and spaced away from the first paper dust removing roller 9*b*. The tip portion 9*p* is bent from an upper end of the base portion 9*n* at an acute angle toward the first paper dust removing roller 9*b*. A gap L between a tip end 9*t* of the tip portion 9*p* and the outer peripheral surface of the first paper dust removing roller 9*b* is in a range of from 0.2 to 2.0 mm, preferably, 0.5 to 2.0 mm. That is, this gap L permits the paper dusts (about several $\mu$mm in size) adhered onto the first paper dust removing roller 9*b* during its normal rotation to pass through the gap toward the first sponge member 9*c*, but prevents a lump of paper dusts (about several mm in size) scrapped off by the first sponge member 9*c* and then released therefrom from passing through the gap toward the sheet transport path 38 during reverse rotation of the first paper dust removing roller 9*b*.

As shown in FIG. 4, the first reverse transportation preventive member 9*m* is designed to provide an angle θ at an intersection between lines Y and Z not more than 90 degrees, in which the line Y is a tangential line with respect to a line X connecting between the tip end 9*t* of the tip end portion 9*p* and a rotational center of the first paper dust removing roller 9*b*, and the line Z is the extending direction of the tip end portion 9*p*. Further, the tip end portion 9*p* is positioned upstream of the line x in the normal rotating direction of the first paper dust removing roller 9*b*. With this arrangement, the tip end 9*t* can confront with and contact with the paper dusts adhered onto the first paper dust removing roller 9*b* from the first sponge member 9*c* during reverse rotation (clockwise rotation in FIG. 4) of the first paper dust removing roller 9*b*.

As shown in FIG. 2, the second transport portion 10 is positioned above and downstream of the first transport portion 9. Further, the second transport portion 10 is positioned downstream of the joining portion between the sheet transport path 38 and the downstream end of the re-circulation path guide 53. The second transport portion 10 includes a second transport roller 10*a* for transporting the sheet 3, a second paper dust removing roller 10*b* positioned in opposition to the second transport roller 10*a* with respect to the sheet transport path 38, a second sponge member 10*c* serving as a scraper disposed immediately below the second paper dust removing roller 10*b*, and a second reverse transportation preventive member 10*m* for preventing the paper dust from being transported from the second sponge member 10*c* to the sheet transport path 38.

The second transfer roller 10*a* is positioned inwardly of the curvature of the sheet transport path 38, and includes a metallic roller shaft 10*d* and a rubber layer 10*e* formed thereover. The roller shaft 10*d* is rotatably supported by the main casing 2. The second transport roller 10*a* is drivingly rotatable in a direction indicated by an arrow, (clockwise direction in FIG. 1) through a power transmission from the motor (not shown). That is, a region of the second transport roller 10*a* confronting the sheet transport path 38 is rotated in the normal direction, i.e., in the sheet feeding direction.

The second paper dust removing roller 10*b* is disposed outwardly of the curvature of the sheet transport path 38, and includes a metallic roller shaft 10*f* and a rubber layer 10*g* having easily chargeable surface. The rubber layer is made from a fluororesin, or rubber whose outer surface is formed with fluorine coating. The second paper dust removing roller 10*b* is so positioned as to brought into contact with an entire sheet surface (to be in contact with the photosensitive drum 23) which has been contacted with the pad member 13*b*. To this effect, a width (axial length) of the rubber layer roller 10*g* is slightly greater than the sheet width A as shown in FIG. 3(*b*).

The main casing 2 has a second support member 100*b*, and the roller shaft 10*f* of the second paper dust removing roller 10*b* is rotatably supported by the support member 100*b*. The second paper dust removing roller 10*b* is positively driven upon power input from a motor (not shown), so that the second paper dust removing roller 10*b* is rotatable in a normal direction indicated by an arrow in FIG. 2, that is, in the sheet feeding direction (counter clockwise direction in FIG. 1) at a region facing with the sheet transport path 38. The sheet 3 is nipped between the second transport roller 10*a* and the second paper dust removing roller 10*b* for feeding, while the paper dust is removed by the second paper dust removing roller 10*b*. The second transport roller 10*a* and second paper dust removing roller 10*b* are reversely rotatable for removing jamming sheet described later.

The second sponge member 10*c* is formed from a material which can easily charge the second paper dust removing roller 10*b*. Typical material is urethane foam. The second sponge member 10*c* is positioned immediately below the second paper dust removing roller 10*b* and in pressure contact therewith at a position opposite to the sheet transport path 38 with respect to the paper dust removing roller 10*b* so as to scrape off the paper dust from the paper dust removing roller 10*b*. The second sponge member 10*c* is in sliding contact with the second paper dust removing roller 10*b* to frictionally charge the surface of the roller 10*g* of the second paper dust removing roller 10*b*. A width of the second sponge member 10*c* is slightly greater than the width (axial length) of the second paper dust removing roller 10*b* as shown in FIG. 3(*b*).

As shown in FIG. 2, the second reverse transportation preventive member 10*m* is disposed downstream of a contacting position between the second paper dust removing roller 10*b* and the sheet 3 in the normal rotating direction of the roller 10*b*, and upstream of a contacting position between the second paper dust removing roller 10*b* and the second sponge member 10*c* in the normal rotating direction of the roller 10*b*. The second reverse transportation preventive member 10*m* extends in parallel with the axial direction of the second paper dust removing roller 10*b* and confronts the roller 10*b* with a predetermined space. The second reverse transportation preventive member 10*m* is L-shape in cross-section having a base portion 10*n* and a tip portion 10*p* bent from the base portion 10*n*. The second reverse transportation preventive member 10*m* is provided integrally with the support member 100*b* as a part of the support member 100*b*. As shown in FIG. 3(*b*), a width of the second reverse transportation preventive member 10*m* is greater than the widths of the second paper dust removing roller 10*b* and the second sponge member 10*c*.

The base portion 10*n* is positioned opposite to the sheet transport path 38 with respect to the second paper dust removing roller 10*b* and slantingly extends in generally vertical direction and spaced away from the second paper dust removing roller 10*b*. The tip portion 10*p* is bent from a lower end of the base portion 10*n* at an acute angle toward the second paper dust removing roller 10*b*. A gap between a tip end of the tip portion 10*p* and an outer peripheral surface of the second paper dust removing roller 10*b* is in a range of from 0.2 to 2.0 mm, preferably, 0.5 to 2.0 mm. That is, this gap permits the paper dusts (about several $\mu$mm in size) adhered onto the second paper dust removing roller 10*b* during its normal rotation to pass through the gap toward the second sponge member 10*c*, but prevents a lump of paper dusts (about several mm in size) scrapped off by the second sponge member 10*c* from passing through the gap toward the sheet transport path 38 during reverse rotation of the second paper dust removing roller 10*b*.

Similar to the first reverse transportation preventive member 9*m*, the second reverse transportation preventive member 10*m* is designed to provide an angle at an intersection between a tangential line with respect to a line connecting between the tip end of the tip end portion 10*p* and a rotational center of the second paper dust removing roller 10*b* and an extension line of the tip end portion 10*p* as being not more than 90 degrees. Further, the tip end portion 10*p* is positioned upstream of the line connecting between the tip end of the tip end portion 10*p* and the rotational center of the second paper dust removing roller 10*b* in the normal rotating direction of the second paper dust removing roller 10*b*. With this arrangement, the tip end of the second reverse transportation preventive member 10*m* can confront with and contact with the paper dusts adhered onto the second paper dust removing roller 10*b* from the second sponge member 10*c* during reverse rotation of the second paper dust removing roller 10*b*.

In the laser printer 1, the sheet 3 stacked on the sheet supply tray 6 is separated from the sheet stack and supplied in cooperation with the sheet supply roller 12 and the separation pad 13. During this sheet supply, a large amount of paper dusts are generated at the image forming surface of the sheet due to the friction against the separation pad 13. However, when the sheet 3 is transported to the first transport portion 9 and the sheet 3 is nipped between the first transport roller 9*a* and the first paper dust removing roller 9*b*, the image forming surface is in brought into contact with the roller 9*g* of the first paper dust removing roller 9*b*. Because the width of the first paper dust removing roller 9*b* is greater than that of the separation pad 13, the paper dusts spreading in a width substantially equal to the width of the pad member 13*b* is scraped off by the roller 9*g* of the first paper dust removing roller 9*b* and are electrostatically absorbed thereon. The paper dusts transferred onto the roller 9*g* of the first paper dust removing roller 9*b* is then scraped off therefrom by the first sponge member 9*c* by the normal rotation of the first paper dust removing roller 9*b,* after the paper dusts passes through the gap L between the first reverse transportation preventive member 9*m* and the first paper dust removing roller 9*b.*

Then, when the sheet 3 is transferred to the second transport portion 10 and the sheet 3 is nipped between the second transport roller 10*a* and the second paper dust removing roller 10*b,* the image forming surface is in brought into contact with the roller 10*g* of the second paper dust removing roller 10*b.* Because the width of the second paper dust removing roller 10*b* is greater than the sheet width, the paper dusts having been generated at the sheet cutting and spreading over entire width of the sheet as well as residual paper dusts which have not been completely removed by the first paper dust removing roller 9*b* can be scraped off by the roller 10*g* of the second paper dust removing roller 10*b* and are electrostatically absorbed thereon. The paper dusts transferred onto the roller 10*g* of the second paper dust removing roller 10*b* is then scraped off therefrom by the second sponge member 10*c* through the normal rotation of the second paper dust removing roller 10*b,* after the paper dusts passes through the gap between the second reverse transportation preventive member 10*m* and the second paper dust removing roller 10*b.*

Accordingly, greater amount of paper dusts generated by the friction of the sheet against the pad member 13*b* can be removed from the sheet by the first and second paper dust removing rollers 9*b* and 10*b,* and a lesser amount of paper dusts inherently generated upon sheet cutting can be removed by the second paper dust removing roller 10*b.* As a results, the above described paper dusts can be removed efficiently and uniformly over the surface of the sheet by the first and second transport portions 9 and 10. Consequently, entry of the paper dusts into the image forming section 5 can be prevented effectively to provide high quality image.

The paper dusts removed by the first and second transport portions 9, 10 are scraped by the first and second sponge members 9*c,* 10*c,* and accumulated thereon to become paper dust lumps, which are then fallen down onto a receiving surface 65 described later.

Because the second paper dust removing roller 10*b* is disposed downstream of the first paper dust removing roller 9*b* in the sheet feeding direction, the sheet 3 supplied by the sheet supply section 7 is first subjected to paper dust removal by the first paper dust removing roller 9*b,* the dust being generated in greater amount due to the friction against the pad member 13*b,* and then, subjected to paper dust removal by the second paper dust removing roller 10*b,* the dust having being inherently spreading in a lesser amount over the entire surface of the sheet due to paper cutting. Accordingly, efficient paper dust removal in accordance with the amount of paper dust can be performed, thereby achieving uniform paper dust removal.

Further, since the width of the second paper dust removing roller 10*b* is greater than the sheet width whereas the width of the first paper dust removing roller 9*b* is greater than that of the separation pad 13 and smaller than the width of the second paper dust removing roller 10*b,* the first paper dust removing roller 9*b* does not necessarily has a longer width but has an optimum width yet performing sufficient paper dust removal. Thus, production cost can be lowered.

Further, as described above, in the laser printer 1, the first paper dust removing roller 9*b* is spaced away from and downstream of the sheet supply roller 12 by a predetermined space to avoid direct contact therewith. Assuming that the first paper dust removing roller 9*b* is in direct contact with the sheet supply roller 12. If a subsequent sheet 3 is slightly pulled out and follows a precedent sheet 3 in partly overlapping relation with the precedent sheet due to the frictionally sliding relationship between the sheet supply roller 12 and the separation pad 13, operation of the laser printer 1 may be stopped while the leading end portion of the subsequent sheet is nipped between the sheet supply roller 12 and the first paper dust removing roller 9*b.* Therefore, the nipped leading end portion of the subsequent sheet may be shaped into a curl. Therefore, sheet jamming may occur due to the subsequent feeding of the curly sheet, or image distortion may occur at the curled portion.

However, because the first paper dust removing roller 9 is positioned out of contact from the sheet supply roller 12, no nipping occurs at the leading end portion of the subsequent sheet even if the subsequent sheet is slightly pulled out and follows the precedent sheet. This prevents the leading end portion from being curled. Consequently, sufficient sheet supply is achievable while sufficiently removing the paper dust removal.

Further, in the first and second sheet transport portions 9 and 10, the first sponge member 9*c* is provided in confrontation with the first paper dust removing roller 9*b* to scrape off the paper dust adhered to the first paper dust removing roller 9*b,* and the second sponge member 10*c* is provided in confrontation with the second paper dust removing roller 10*b* to scrape off the paper dust adhered to the second paper dust removing roller 10*b.* Thus, paper dust scraping is performed at each sponge member for each paper dust removing roller. As a result, paper dust removing efficiency of each paper dust removing roller can be maintained enabling paper dust removing for a long duration.

Incidentally, because the width of the first and second sponge members 9*c* and 10*c* is slightly greater than the width of the associating first and second paper dust removing rollers 9*b* and 10*b,* respectively, paper dust can be desirably scraped off even if a paper dust area slightly exceeds from the width of the paper dust removing rollers due to the pressure contact between the sheet and the paper dust removing rollers.

Further, in the laser printer 1, the sheet 3 supplied by the sheet supply section 7 is first delivered by the first transport roller 9*a* and the first paper dust removing rollers 9*b* while the paper dusts are removed, and is then delivered by the second transport roller 10*a* and the second paper dust removing rollers 10*b* while the paper dusts are again removed. Therefore, desirable sheet transportation to the image forming section 5 results while performing efficient paper dust removal.

Further, the second paper dust removing roller 10*b* is not slave-driven by the second transport roller 10*a* but the second paper dust removing roller 10*b* is a self-driving component, because it is supplied with driving power from the motor (not shown). Therefore, constant rotation of the second paper dust removing roller 10*b* can result to perform effective paper dust removal and effective sheet feeding, even if a resistive load is applied to the entirety of the roller portion 10*g* of the second paper dust removing roller 10*b* due to the contact with the sheet 3 and the second sponge member 10*c.*

Further, in the laser printer 1, the re-circulation unit 41 is provided, and the first transport portion 9 is disposed upstream of the joint portion between the sheet transport path 38 and the re-circulation path guide 53, whereas the second transport portion 10 is disposed downstream of the joint portion. With such a construction, since the first paper dust removing roller 9*b* is disposed upstream of the joint portion, the first paper dust removing roller 9*b* is exclusively in contact with the sheet 3 supplied from the sheet supply section 7. Further, since the second paper dust removing roller 10*b* is disposed downstream of the joint portion, the second paper dust removing roller 10*b* is in contact with the sheet supplied from the sheet supply section 7 and the sheet supplied from the re-circulation path guide 53.

Therefore, the first paper dust removing roller 9*b* removes the greater amount of paper dusts generated due to the friction against the pad member 13*b* with respect to the sheet supplied from the sheet supply section 7, whereas the second paper dust removing roller 10*b* removes the paper dust on the sheet which has been subjected to paper dust removal by the first paper dust removing roller 9*b* and which has been fed from the sheet supply section 7, and also removes the paper dust on the sheet fed from the re-circulation path guide 53. Regarding the sheet fed from the re-circulation path guide 53, one image forming surface which has been in contact with the roller portion 9*g* of the first paper dust removing roller 9*b* is not in confrontation with the second paper dust removing roller 10*b*, but an opposite surface of the sheet is in contact therewith. Because the opposite surface of the sheet does not carry the paper dusts caused by the friction against the pad member 13*b*. Accordingly, the second paper dust removing roller 10*b* can only remove the lesser amount of paper dusts caused by paper cutting over the entire surface of the sheet.

As shown in FIG. 1, the feeder portion 4 of the laser printer 1 also includes a multiple purpose tray 14 for stacking thereon a stack of a random size sheets 3, a multiple purpose sheet supply mechanism 15 for supplying the sheet on the multiple purpose tray 14, and a multiple purpose sheet transport portion 16.

As shown in FIG. 2, the multiple purpose sheet supply mechanism 15 includes a multiple purpose sheet supply roller 15*a* and a multiple purpose separation pad 15*b* positioned in direct confrontation with the multiple purpose sheet supply roller 15*a*. The multiple purpose separation pad 15*b* includes a support frame 15*c*, a multiple purpose pad member 15*d* and a spring 15*e*.

The support frame 15*c* has a base end portion pivotally supported to the main casing 2 and having an L-shape cross-section, and a free end portion integral with the base end portion and in confrontation with and below the multiple purpose sheet supply roller 15*a*. The free end portion is embedded with the multiple purpose pad member 15*d*, and the spring 15*e* is seated on the other side of the pad member 15*d* for normally urging the multiple purpose pad member 15*d* toward the sheet supply roller 15*a*.

The multiple purpose pad member 15*d* has a generally rectangular plate shape and is made from an elastic material such as polyurethane rubber. A width of the multiple purpose separation pad 15*b* has such width as to contact with a widthwise center portion of the sheet for the sheet feeding.

Upon rotation of the multiple purpose sheet supply roller 15*a*, an uppermost sheet on the sheet stack on the multiple purpose tray 14 is nipped between the multiple purpose sheet supply roller 15*a* and the multiple purpose separation pad 15*b*. In this manner each uppermost sheet is separated from the sheet stack and is delivered.

The multiple purpose transport portion 16 is positioned above the second transport portion 10, downstream of the multiple purpose sheet supply mechanism 15 and upstream of the register roller 11 disposed at a sheet transport path 38*a* between the multiple purpose sheet supply mechanism 15 and the image forming section 5. The multiple purpose transport portion 16 includes a multiple purpose transport roller 16*a* for transporting the sheet 3, a multiple purpose paper dust removing roller 16*b* in confrontation therewith, a multiple purpose sponge member 16*c* as a scraping member immediately below the multiple purpose paper dust removing roller 16*b*, and a multiple purpose reverse transportation preventive member 16*m* for preventing the paper dusts released from the multiple purpose sponge member 16*c* from being transported into the sheet transport path 38*a*.

The multiple purpose transport roller 16*a* includes a metallic roller shaft 16*d* and a rubber layer 16*e* formed thereover. The roller shaft 16*d* is rotatably supported by the main casing 2, and is drivingly rotatable in a direction indicated by an arrow in FIG. 2 (counterclockwise direction in FIG. 1) through a power transmission from a motor (not shown). That is, the region of the roller 16*a* in confrontation with the sheet transport path 38*a* is drivingly rotated in the normal direction the same as the sheet feeding direction.

The multiple purpose paper dust removing roller 16*b* includes a metallic roller shaft 16*f* and a rubber layer 16*g* having easily chargeable surface. The rubber layer is made from a fluororesin, or rubber whose outer surface is formed with fluorine coating. The multiple paper dust removing roller 16*b* is so positioned as to brought into contact with the sheet surface which has been contacted with the multiple purpose pad member 15*d*, and to align with a center portion of the multiple purpose transport roller 16*a*, the center portion being in confrontation with the multiple purpose separation pad 15*b*. The width (axial length) of the multiple purpose rubber layer roller 16*g* is slightly greater than a width of the multiple purpose pad member 15*d*.

The main casing 2 has a support member 100*c*, and the roller shaft 16*f* of the multiple purpose paper dust removing roller 16*b* is rotatably supported by the support member 100*c*. The multiple purpose paper dust removing roller 16*b* is driven by the multiple purpose transport roller 16*a*, and is rotated in a direction indicated by an arrow (clockwise direction) in FIG. 2, that is, in the sheet feeding direction at a region facing with the sheet transport path 38*a*. The sheet 3 is nipped between the multiple purpose transport roller 16*a* and the multiple purpose paper dust removing roller 16*b* for feeding, while the paper dust is removed by the multiple purpose paper dust removing roller 16*b*. The multiple purpose transport roller 16*a* and the multiple purpose paper dust removing roller 16*b* are reversely rotatable for removing jamming sheet.

The multiple purpose sponge member 16*c* is formed from a material which can easily charge the multiple purpose paper dust removing roller 16*b*. Typical material is urethane foam. The multiple purpose sponge member 16*c* is positioned immediately below the multiple purpose paper dust removing roller 16*b* and in pressure contact therewith at a position opposite to the sheet transport path 38*a* extending from the multiple purpose sheet supply mechanism 15 with respect to the paper dust removing roller 16*b* so as to scrape off the paper dust from the paper dust removing roller 16*b*. A width of the multiple purpose sponge member 16*c* is slightly greater than the width of the roller 16*g* of the multiple purpose paper dust removing roller 16*b*. The multiple purpose sponge member 16*c* is in sliding contact with the multiple purpose paper dust removing roller 16*b* to frictionally charge the surface of the roller portion 16*g* of the multiple purpose paper dust removing roller 16*b*.

As shown in FIG. 2, the multiple purpose reverse transportation preventive member 16*m* is disposed downstream of a contacting position between the multiple purpose paper dust removing roller 16*b* and the sheet 3 in the normal rotating direction of the roller 16*b*, and upstream of a contacting position between the multiple purpose paper dust removing roller 16*b* and the multiple purpose sponge member 16*c* in the normal rotating direction of the roller 16*b*. The multiple purpose reverse transportation preventive member 16*m* extends in parallel with the axial direction of the multiple purpose paper dust removing roller 16*b* and confronts the roller 16*b* with a predetermined space. The multiple purpose reverse transportation preventive member 16*m* is L-shape in cross-section having a base portion 16*n* and a tip portion 16*p* bent from the base portion 16*n*. The multiple purpose reverse transportation preventive member 16*m* is provided integrally with the support member 100*c* of the main casing 2 as a part of the support member 100*c*. A width of the multiple purpose reverse transportation preventive member 16*m* is greater than the widths of the multiple purpose paper dust removing roller 16*b* and the multiple purpose sponge member 16*c*.

As shown in FIG. 2 the base portion 16*n* is positioned opposite to the sheet transport path 38*a* with respect to the multiple purpose paper dust removing roller 16*b* and therebelow, and slantingly extends in generally vertical direction and spaced away from the multiple purpose paper dust removing roller 16*b*. The tip portion 16*p* is bent from an upper end of the base portion 16*n* at an acute angle toward the multiple purpose paper dust removing roller 16*b*. A gap between a tip end of the tip portion 16*p* and the multiple purpose paper dust removing roller 16*b* is in a range of from 0.2 to 2.0 mm, preferably, 0.5 to 2.0 mm. That is, this gap permits the paper dusts (about several $\mu$mm in size) adhered onto the multiple purpose paper dust removing roller 16*b* during its normal rotation to pass through the gap toward the multiple purpose sponge member 16*c*, but prevents a lump of paper dusts (about several mm in size) scrapped off by the multiple purpose sponge member 16*c* and released therefrom from passing through the gap toward the sheet transport path 38*a* during reverse rotation of the multiple purpose paper dust removing roller 16*b*.

Similar to the first reverse transportation preventive member 9*m*, the multiple purpose reverse transportation preventive member 16*m* is designed to provide an angle at an intersection between a tangential line with respect to a line connecting between the tip end of the tip end portion 16*p* and a rotational center of the multiple purpose paper dust removing roller 16*b* and an extension line of the tip end portion 16*p* as being not more than 90 degrees. Further, the tip end portion 16*p* is positioned upstream of the line connecting between the tip end of the tip end portion 16*p* and the rotational center of the multiple purpose paper dust removing roller 16*b* in the normal rotating direction of the multiple purpose paper dust removing roller 16*b*. With this arrangement, the tip end of the multiple purpose reverse transportation preventive member 16*m* can confront with and contact with the paper dusts adhered onto the multiple purpose paper dust removing roller 16*b* from the multiple purpose sponge member 16*c* during reverse rotation of the multiple purpose paper dust removing roller 16*b*.

The sheet 3 stacked on the multiple purpose sheet supply tray 14 in the multiple purpose sheet supply mechanism 15 is separated from the sheet stack and supplied in cooperation with the multiple purpose sheet supply roller 15*a* and the multiple purpose separation pad 15*b*. During this sheet supply, a large amount of paper dusts are generated at the surface of the sheet due to the friction against the multiple purpose separation pad 15*b*. However, when the sheet 3 is transported to the multiple purpose transport portion 16 and the sheet 3 is nipped between the multiple purpose transport roller 16*a* and the multiple purpose paper dust removing roller 16*b*, the paper dusts generated upon friction against the multiple purpose separation pad 15*b* and spreading in a width substantially equal to the width of the multiple purpose pad member 15*d* is scraped off by the roller 16*g* of the multiple purpose paper dust removing roller 16*b* and are electrostatically absorbed thereon, because the width of the multiple purpose paper dust removing roller 16*b* is slightly greater than that of the multiple purpose separation pad 15*b*. The paper dusts transferred onto the roller 16*g* of the multiple purpose paper dust removing roller 16*b* is then scraped off therefrom by the multiple purpose sponge member 16*c* by the rotation of the multiple purpose paper dust removing roller 16*b* in the direction of arrow (clockwise direction in FIG. 2) after the paper dusts pass through the gap between the multiple purpose reverse transportation preventive member 16*m* and the multiple purpose paper dust removing roller 16*b*.

In this way, paper dust generated upon friction against the multiple purpose separation pad 15*b* and spreading over the width of the multiple purpose separation pad 15*b* can be desirably removed off from the surface of the sheet 3. The paper dusts will become a paper dust lump after scraped off from multiple purpose paper dust removing roller 16*b* by the multiple purpose sponge member 16*c* and being deposited thereon, and then the paper dust lump will be falling down onto the receiving surface 65 as described later.

In the laser printer 1, when sheet jamming occurs at a sheet nipping state between the first transport roller 9*a* and the first paper dust removing roller 9*b*, or between the second transport roller 10*a* and the second paper dust removing roller 10*b* during sheet feeding to the image forming section 5 through the sheet transport path 38, the jammed sheet can be pulled out from the sheet supply section 7, i.e., from the lower side of the first transport portion 9 after pulling out the sheet supply tray 6. In such a case, the first paper dust removing roller 9*b* and the second paper dust removing roller 10*b* those in contact with the sheet 3 are reversely rotated, which causes the paper dust lumps scraped by and accumulated on the first and second sponge members 9*c* and 10*c* to be transported back toward the first paper dust removing roller 9*b* and the second paper dust removing roller 10*b*.

However, during the reversal rotation of the first paper dust removing roller 9*b* and the second paper dust removing roller 10*b*, the paper dust lumps cannot pass through the gap L between the tip end 9*t* of the first reverse transportation preventive member 9*m* and the first paper dust removing roller 9*b* nor through the gap between the second reverse transportation preventive member 10*m* and the second paper dust removing roller 10*b* when the lumps are brought into confrontation with the tip end portions of the first and second reverse transportation preventive members 9*m*, 10*m*, respectively. Thus, the lumps are dammed at the tip end portions 9*p*, 10*p* of the first and second reverse transportation preventive member 9*m*, 10*m*, respectively. Therefore, these lumps cannot be introduced into the sheet transport path 38.

Accordingly, even by the reversal rotations of the first and second paper dust removing rollers 9*b*, 10*b* during removal of the jamming sheet, the paper dusts collected by the first and second sponge members 9*c*, 10*c* will not be discharged into the sheet transport path 38. Consequently, a subsequent sheet can be protected against such paper dusts. Thus, adhesion of paper dusts onto the photosensitive drum 23 can be obviated, and a desirable image formation can result.

Similarly, when sheet jamming occurs at a sheet nipping state between the multiple purpose transport roller 16*a* and the multiple purpose paper dust removing roller 16*b* during sheet feeding to the image forming section 5 through the sheet transport path 38*a*, the jammed sheet can be pulled out from the sheet supply section, i.e., from the multiple purpose supply tray 14. In such a case, the multiple purpose paper dust removing roller 16*b* in contact with the sheet 3 is reversely rotated, which causes the paper dust lumps scraped by and accumulated on the multiple purpose sponge member 16*c* to be transported back in accordance with the reverse rotation of the multiple purpose paper dust removing roller 16*b*.

However, during the reversal rotation of the multiple purpose paper dust removing roller 16*b*, the paper dust lump cannot pass through the gap between the multiple purpose reverse transportation preventive member 16*m* and the multiple purpose paper dust removing roller 16*b* when the lump is brought into confrontation with the tip end portion 16*p* of the multiple purpose reverse transportation preventive member 16*m*. Thus, the lump is dammed at the tip end portion 16*p* of the multiple purpose reverse transportation preventive member 16*m*. Therefore, the lump cannot be introduced into the sheet transport path 38*a*.

Accordingly, even by the reversal rotation of the multiple purpose paper dust removing roller 16*b* during removal of the jamming sheet, the paper dusts collected by the multiple purpose sponge member 16*c* will not be discharged into the sheet transport path 38*a*. Consequently, a subsequent sheet can be protected against the paper dusts. Thus, adhesion of paper dusts onto the photosensitive drum 23 can be obviated, and a desirable image formation can result.

Further, in the laser printer 1, because of the above described gap distance ranging from 0.2 to 2.0 mm, the respective gaps allow the paper dusts to pass therethrough toward the first sponge member 9*c*, the second sponge member 10*c* and the multiple purpose sponge member 16*c*, respectively, during normal rotations of the first paper dust removing roller 9*b*, the second paper dust removing roller 10*b* and the multiple purpose paper dust removing roller 16*b*, but the gaps prevent the paper dusts from passing therethrough in the reverse direction during reverse rotations of the first paper dust removing roller 9*b*, the second paper dust removing roller 10*b* and the multiple purpose paper dust removing roller 16*b*. Thus, with such a simple arrangement, paper dusts adhered onto the rollers 9*b*, 10*b*, 16*b* can surely be transported to the sponge members 9*c*, 10*c*, 16*c*, and reversal transportation of the paper dusts from the sponge members 9*c*, 10*c*, 16*c* to the transport paths 38, 38*a* can be prevented.

Further, because of the above described orientations of the tip end portions 9*p*, 10*p* and 16*p* of the first reverse transportation preventive member 9*m*, second reverse transportation preventive member 10*m* and multiple purpose reverse transportation preventive member 16*m*, the tip end portions 9*p*, 10*p*, 16*p* can confront and contact with the paper dust lumps transported back in accordance with the reverse rotations of these rollers 9*b*, 10*b*, 16*b*. Therefore, the paper dust lumps cannot be transported back any more. Thus, the first reverse transportation preventive member 9*m*, second reverse transportation preventive member 10*m* and multiple purpose reverse transportation preventive member 16*m* can prevent reversal transportation of the paper dust lumps.

Further, because of the above described relationship between widths of the reverse transportation preventive members 9*m*, 10*m* and 16*m* and widths of the associated rollers 9*b*, 10*b*, 16*b* and the sponge members 9*c*, 10*c*, 16*c*, respectively, in the reverse rotations of the first paper dust removing roller 9*b*, second paper dust removing roller 10*b*, and multiple purpose paper dust removing roller 16*b*, the paper dust lumps can surely be blocked by the first reverse transportation preventive member 9*m*, second reverse transportation preventive member 10*m* and multiple purpose reverse transportation preventive member 16*m*, even if the paper dust lumps are spreading over the entire width of the sponge members 9*c*, 10*c*, 16*c*, and these paper dust lumps are transferred toward the rollers 9*b*, 10*b*, 16*b* over their entire widths.

Further, the first reverse transportation preventive member 9*m*, second reverse transportation preventive member 10*m*, and multiple purpose reverse transportation preventive member 16*m* are not separate members but provided integrally with the support members 100*a*, 100*b*, 100*c* of the main casing 2, respectively. Therefore, the first reverse transportation preventive member 9*m*, second reverse transportation preventive member 10*m*, and multiple purpose reverse transportation preventive member 16*m* can be easily formed to reduce the number of mechanical components, to thus lower the production cost.

Figure 5:
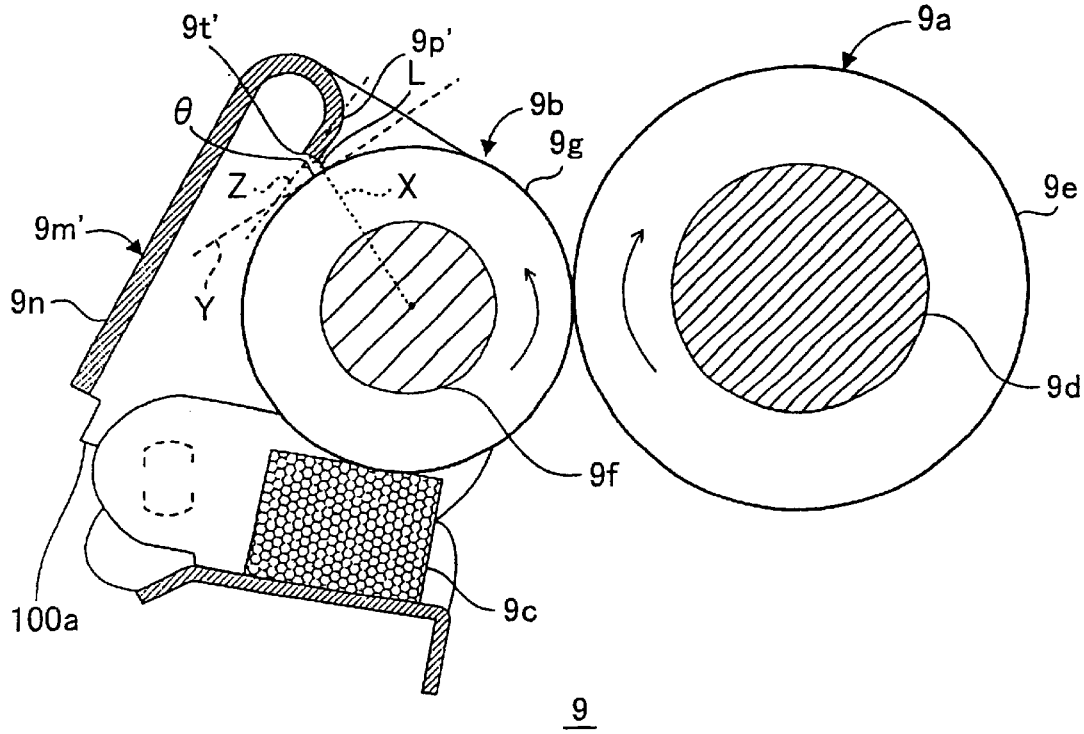
FIG. 5 is an enlarged cross-sectional view showing a modification to the first transport portion of FIG. 4.

Further, in the above described embodiment, taking the first reverse transportation preventive member 9*m* for instance, the base portion 9*n* and the tip end portion 9*p* are flat plate shapes, and the base end portion 9*n* and the tip end portion 9*p* are formed by bending at an acute angle at a proper portion. Instead of this arrangement, as shown in FIG. 5, another arrangement of the first reverse transportation preventive member 9*m*' is conceivable such that a tip end portion 9*p*' is an extension of a curved portion instead of the acute angled bent portion. In the modification, a tip end face 9*t*' is directed to confront against the reversal rotation of the first paper dust removing roller 9*b*, and the tip end portion 9*p*' is intersected with the tangential line at an angle not more than 90 degrees, and further, the tip end portion 9*b* is disposed upstream of the line X connecting between the tip end face 9*t*' and the rotational center of the first paper dust removing roller 9*b* in the normal rotating direction thereof.

(3) Paper Dust Chute

The paper dusts scraped by the first sponge member 9*c*, the second sponge member 10*c*, and the multiple purpose sponge member 15*c* are dropped down from each sponge due to gravity when the scraped paper dust has become a mass or lump of a predetermined size. In the laser printer 1, there is provided a paper dust chute 39 for guiding downward travel of the paper dust mass. The paper dust chute 39 vertically extends in front of the sheet transport path 38 and is constituted by a guide plate section 61, an extension section 62 and a partition plate 63.

The guide plate 61 is a thin plate like member constituting a front side of the sheet transport path 38 so as to guide the sheet 3 from the sheet supply section 7 to the image forming section 5. Thus, the guide plate 61 has one side serving as the sheet transport path 38, and another side serving as the paper dust chute. More specifically, the guide plate 61 includes a first guide plate 61*a* for directing the sheet 3 from the second transport portion 10 to the register roller 11, and a second guide plate 61*b* for directing the sheet 3 from the first transport portion 9 to the second transport portion 10.

The first guide plate 61*a* is a thin plate member slantingly extending from an upper space of the second transport portion 10 to the front of the register roller 11. The first guide plate 61*a* has one side face guiding the travel of the sheet 3 from the second transport portion 10 to the register roller 11. Another side face of the first guide plate 61*a* allows the paper dust falling from the multiple purpose transport portion 16 positioned above the first guide plate 61*a* to direct downwardly. The first guide plate 61*a* has a lower end integrally provided with an extension portion 62*a* slantingly extending downwardly for covering an upper portion of the second transport portion 10.

The second guide plate 61*b* is a thin plate member and is moderately curved in S-shape from the lower space of the second transport portion 10 to the lower space of the first transport portion 9. The second guide plate 61*b* has one side face guiding the travel of the sheet 3 from the first transport portion 9 to the second transport portion 10. Another side face of the second guide plate 61*b* allows the paper dust falling from the second transport portion 10 positioned above the second guide plate 61*b* to direct downwardly as well as the paper dust falling from the multiple purpose transport portion 16. The second guide plate 61*b* has an intermediate portion provided with a thin plate-like extension portion 62*b* slantingly extending downwardly for covering an upper portion of the first transport portion 9.

Further, the base end portions 9*n*, 10*n* of the first and second reverse transportation preventive member 9*m*, 10*m* also serve as guide members for guiding downward travel of the falling paper dusts.

Incidentally, a third guide plate 61*c* is formed continuously from the second guide plate 61*b* at a position lower than the confronting position between the first paper dust removing roller 9*b* and the first sponge member 9*c*. The third guide plate 61*c* has a lower end portion bent horizontally at a position above the attachment/detachment path of the sheet supply tray 6.

The partition plate 63 is positioned in front of the second guide plate 61*b* with a predetermined space therefrom. The partition plate 63 includes a side plate 63*c* extending in a vertical direction and a bottom plate 63*d* bent at substantially right angle from a lower end of the side plate 63*c* toward frontward.

Further, a front side bottom wall 64 is provided in front of and below the first paper dust removing roller 9*b* and first sponge member 9*c*. The front side bottom wall 64 positioned above and extends in parallel with the attachment/detachment path of the sheet supply tray 6, and has a front end portion contiguous with a front wall of the main casing 2, and a rear end portion serving as the receiving surface 65 for receiving thereon the paper dusts falling down from the multiple purpose transport portion 16, the second transport portion 10, and the first transport portion 9.

The receiving surface 65 includes a recessed portion 66, a slant wall portion 67 and a ridge portion 68. The recessed portion 66 has a semi-circular cross-section and is positioned opposite to the sheet transport path 38 with respect to the first paper dust removing roller 9*b* and the first sponge member 9*c*, and extends in the axial direction of the first paper dust removing roller 9*b*. The slant wall portion 67 is positioned closer to the sheet transport path 38 than the recessed portion 66 to the sheet transport path 38, and is slanted upwardly toward the sheet transport path 38. The ridge portion 68 is positioned opposite to the first paper dust removing roller 9*b* and first sponge member 9*c* with respect to the recessed portion 66, and has a height lower than the upper end portion of the slant wall portion 67. Incidentally, an auger member (spiral feed member) 71 as paper dust transport unit described later is provided at a space of the recessed portion 66.

With this arrangement, the paper dust scraped by the multiple purpose sponge member 16*c* in the multiple purpose transport portion 16 and becoming paper dust lumps are guided along the first guide plate 61*a* and dropped onto the extension portion 62*a*, and also guided along the base end portion 10*n* of the second reverse transportation preventive member 10*m*. Then, the paper dusts are further guided along the second guide plate 61*b* and dropped onto the extension portion 62*b*, and then guided along the base end portion 9*n* of the first reverse transportation preventive member 9*m*, and then dropped onto the receiving surface 65.

Further, the paper dusts scraped by the second sponge member 10*c* in the second transport portion 10 and becoming the lumps are guided along the second guide plate 61*b* and dropped onto the extension portion 62*b*, and then guided along the base end portion 9*n* of the first reverse transportation preventive member 9*m*. Then, the paper dusts are dropped onto the receiving surface 65. The paper dusts scraped by the first sponge member 9*c* and becoming the lumps are dropped onto the receiving surface 65.

Incidentally, in the laser printer 1, the base end portions 9*n*, 10*n* of the first and second reverse transportation preventive members 9*m*, 10*m* also serve as guide members for guiding downward travel of the paper dusts. Therefore, additional guide members are not required at side areas of the first and second paper dust removing rollers 9*b*, 10*b*. Accordingly, simple construction results with reducing mechanical components, to thus lower the production cost.

(4) Transportation and Collection of Paper Dust

Figure 7:
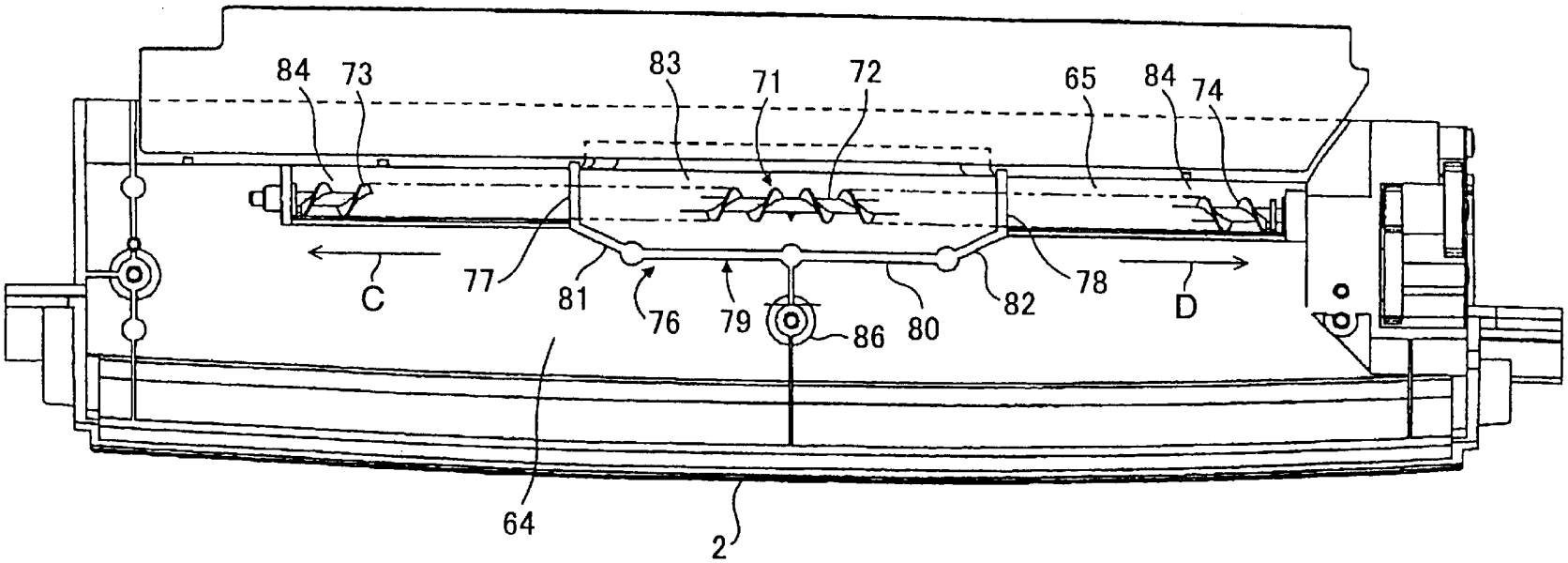
FIG. 7 is a plan view showing an essential portion around the auger member in the laser printer of FIG. 1.

The laser printer 1 provides, as shown in FIGS. 6 and 7, the auger member 71 for transporting the paper dusts falling on the receiving surface 65 from a paper dust falling down area 83 to paper dust accumulating portions 84 those described later.

The auger member 71 is disposed along the recessed portion 66 of the receiving surface 65. As shown in FIGS. 6 and 7, the auger member 71 includes a shaft member 72, a first spiral portion 73 and a second spiral portion 74 integrally mounted over the shaft member 72. Spiral direction of the second spiral portion 74 is opposite to that of the first spiral portion 73. An auger drive gear 75 is mounted on one end of the shaft member 72 and beside the second spiral portion 74 for drivingly rotating the auger member 71 through a gear train 90 described later connected to a motor (not shown).

Figure 8:
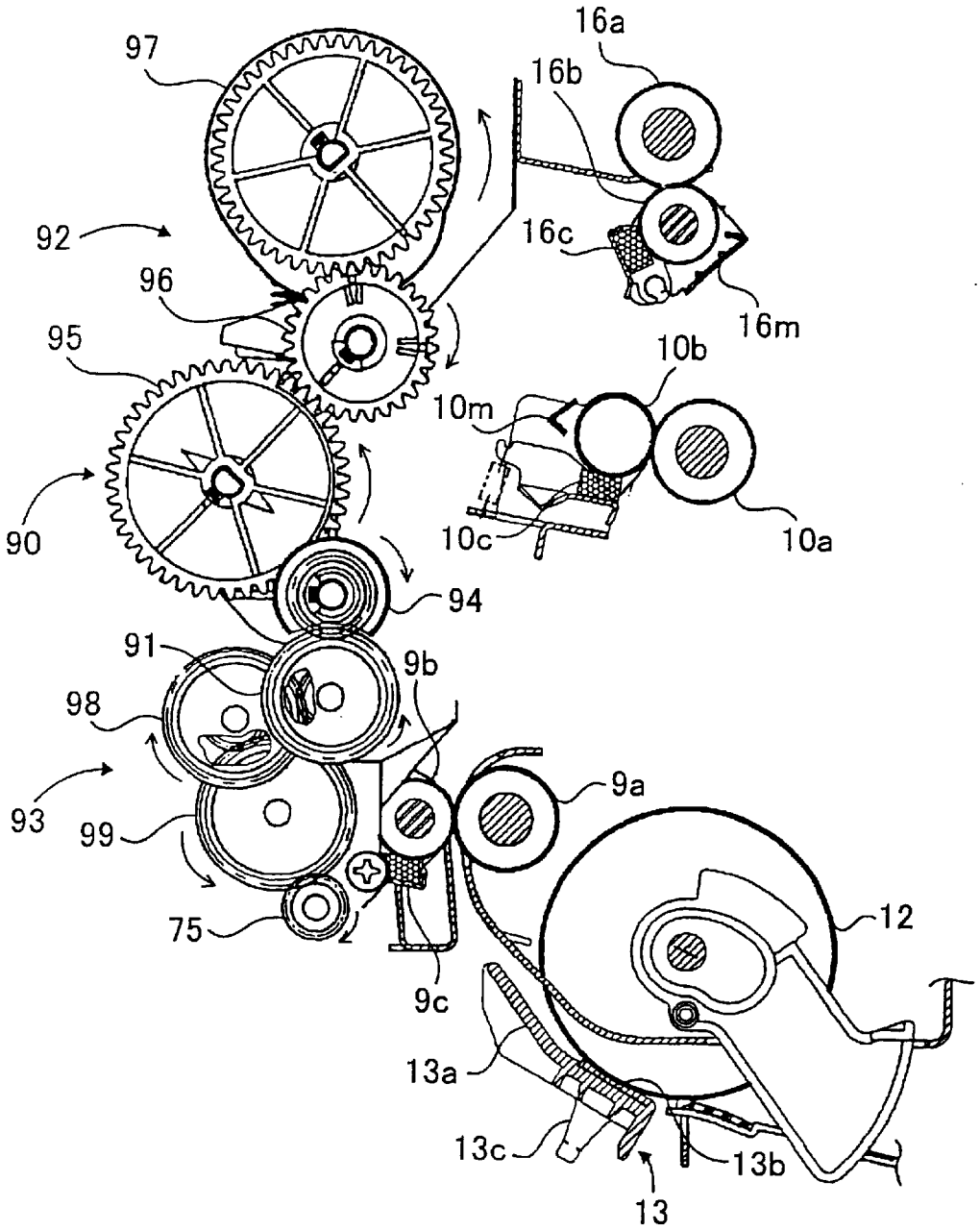
FIG. 8 is a cross-sectional view showing gear transmission mechanism disposed adjacent to a sheet transportation path of the laser printer shown in FIG. 1.

More specifically, as shown in FIG. 8, the gear train 90 includes a motor coupling gear 91, an upper gear train 92 for transmitting power from the motor coupling gear 91 to the multiple purpose sheet supply mechanism 15 for driving the same, and a lower gear train 93 for transmitting power from the motor coupling gear 91 to the auger member 71 for drivingly rotating the same. The motor coupling gear 91 is a two sage gear including a large diameter gear in meshing engagement with the upper gear train 92 and a small diameter gear in meshing engagement with the lower gear train 93.

The upper gear train 92 includes three transmission gears 94, 95, 96 arrayed in a vertical direction. A multiple purpose sheet supply roller drive gear 97 is fixedly mounted on one end of the roller shaft of the multiple purpose sheet supply roller 15*a*. The transmission gear 96 is meshedly engaged with the multiple purpose sheet supply roller drive gear 97, so that the latter is rotatable in the counterclockwise direction by the rotation of the large diameter gear of the motor coupling gear 91 through the transmission gears 94, 95, 96.

The lower gear train 93 includes two transmission gears 98,99 arrayed in the vertical direction. The transmission gear 99 is meshedly engaged with the auger drive gear 75, so that the shaft member 72 of the auger member 71 is rotatable in a clockwise direction by the rotation of the small diameter gear of the motor coupling gear 91 through the transmission gears 98, 99.

Thus, as shown in FIG. 2, the auger member 71 is rotated such that the its surface moves downwardly at a side in confrontation with the slant wall portion 67 on the receiving surface 65 and moves upwardly at a side in confrontation with the ridge portion 68.

As show in FIGS. 6 and 7, the first spiral portion 73 is disposed at axially half length of the shaft member 72 and is adapted for transporting the paper dusts toward one axial end of first paper dust removing roller 9*b* (C direction in FIG. 6) upon rotation of the shaft member 72. The second spiral portion 74 is disposed at axially remaining half length of the shaft member 72 and is adapted for transporting the paper dusts toward other axial end of the first paper dust removing roller 9*b* (D direction in FIG. 6) upon rotation of the shaft member 72. Thus, by the rotation of the shaft member 72 the auger member 72 can transport the paper dusts in opposite directions simultaneously toward both axial ends.

The paper dusts falling from the first transport portion 9, the second transport portion 10 and multiple purpose transport portion 16 can be transported toward both ends of the auger member 71 by the rotation thereof. The thus distributed paper dusts into two directions can be accumulated in the paper dust accumulators 84 described later.

Incidentally, in the laser printer 1, rotation speed of the first paper dust removing roller 9*b* is set to about 180 r.p.m. However, rotation speed of the auger member 71 is lower than that of the first paper dust removing roller 9*b* such as about 60 r.p.m. By setting the rotation sped of the auger member 71 lower than that of the first paper dust removing roller 9*b,* scattering of the paper dusts during their transportation by the auger member 71 can be prevented, and driving noise can be lowered. Further, frictional wearing of the auger member 71 due to the friction against the paper dusts can also be lowered.

The laser printer 1 is provided with a regulation wall 76 at a part of and along the auger member 71. As shown in FIGS. 2, 6 and 7, the regulation wall 76 includes a first partition wall and a second partition wall. The first partition wall includes one side first partition wall 77 disposed across the first spiral portion 73 in a direction perpendicular to the axial direction of the auger member 71, and another side first partition wall 78 disposed across the second spiral portion 74 in a direction perpendicular to the axial direction of the auger member 71. The second partition wall 79 extends in parallel with the auger member 71 with a predetermined space therefrom. One end of the second partition wall 79 is joined to the front end of the one side partition wall 77 and another end of the second partition wall 79 is joined to the front end of the other side partition wall 78, so that the regulation wall 76 is in a U-shape in a plan view.

More specifically, the first partition walls 77, 78 have generally rectangular shape, and have widths in a direction perpendicular to the axial direction of the auger member 71 approximately the same as the width of the receiving surface 65. Lower ends of the first partition walls 77,78 are positioned lower than the contacting region between the first paper dust removing roller 9*b* and the first sponge member 9*c,* and are spaced away from an upper portion of the auger member 71 by a predetermined space. Upper ends of the first partition walls 77,78 are positioned upper than the contact region between the first paper dust removing roller 9*b* and the first sponge member 9*c,* and extend to a lid member 85 described later. The first partition walls 77, 78 are disposed in confronting relation and outwardly of the axial ends of the first paper dust removing roller 9*b* and the first sponge member 9*c*.

The second partition wall 79 includes a central wall 80 extending in parallel with the auger member 71 with a predetermined space therefrom, a one side slant wall 81 extending from and bent at one end of the central wall 80 toward the auger member 71, and another side slant wall 82 extending from and bent at another end of the central wall 80 toward the auger member 71. The central wall 80 and the slant walls 81, 82 are provided integrally with each other.

The one side slant wall 81 extends between the one end of the central wall 80 and the front end of the one side first partition wall 77, and is continuous with the central wall 80. Thus, the one side slant wall 81 provides a gradually narrowing space between the one side slant wall 81 and the auger member 71 toward one end of the auger member 71, i.e., in one paper dust transporting direction C.

The other side slant wall 82 extends between the other end of the central wall 80 and the front end of the other side first partition wall 78, and is continuous with the central wall 80. Thus, the other side slant wall 82 provides a gradually narrowing space between the other side slant wall 82 and the auger member 71 toward the other end of the auger member 71, i.e., in the other paper dust transporting direction D.

The lower end of the second partition wall 79 including the central wall 80 and slant walls 81, 82 is joined with an upper surface of the front side bottom wall 64, whereas the upper end of the second partition wall 79 extends to the lid member 85 described later.

The front side bottom wall 64 including the receiving surface 65 is divided into the paper dust falling portion 83 and the paper dust accumulators 84 by the regulation wall 76 provided by the first partition walls 77, 78 and the second partition wall 79.

That is, the paper dust falling portion 83 is a region on the front side bottom wall 64 and at the axially center portion of the auger member 71 and below the first paper dust removing roller 9*b* and the first sponge member 9*c,* so that the paper dusts scraped off from the first paper dust removing roller 9*b* are falling on the region. This region is an interior of the first partition walls 77, 78 and the second partition wall 79. On the other hand, the paper dust accumulators 84 are regions on the front side bottom wall 64 and adjacent to each end of the auger member 71 where the paper dusts transported by the auger member 71 are accumulated. The latter regions are an exterior of the first partition walls 77, 78 and the second partition wall 79.

Paper dusts scraped off at the multiple purpose transport portion 16, second transport portion 10 and first transport portion 9 and falling onto the paper dust falling portion 83 are transported toward the paper dust accumulators 84 at both ends of the auger member 71 according to the rotation of the auger member 71. During the transportation, since the one slant wall 81 and the other slant wall 82 of the second partition wall 79 are directed to gradually reduce the width of the transportation passage between the wall and the auger member 71 toward the transporting direction, paper dusts transported by the auger member 71 can be guided toward one side partition wall 77 and the other side partition wall 78 by the slant walls 81, 82. Accordingly, the paper dusts transported by the auger member 71 can be smoothly and desirably moved past through the lower edge of the one and the other side partition walls 77, 78, and can reach the paper dust accumulators 84 each disposed downstream of the first partition walls. Further, the one side and other side partition walls 77, 78 can prevent paper dusts already accumulated in the paper dust accumulator 84 from being reversely moved, i.e., from being returned back to the paper dust falling portion 83 disposed upstream of the partition walls 77, 78 in the paper dust transporting direction. Consequently, sufficient falling length from the first transport portion 9 to the auger member 71 can be obtained at the paper dust falling portion 83. As a result, sufficient amount of paper dusts can be deposited on the paper dust falling portion 83, and can be removed therefrom.

Incidentally, in the laser printer 1, since the first transport portion 9 is first brought into contact with the sheet 3 supplied from the sheet supply section 7, greater amount of paper dusts may be released from the first transport portion 9. However, since the paper dust falling portion 83 is isolated from the first transport portion 9 by the regulation wall 76 as a region surrounding the lower front side of the first transport portion 9, the paper dusts can be fallen into the paper dust falling portion 83 and thereafter transported by the auger member 71. Accordingly, sufficient amount of paper dust removal can be attained with ensuring sufficient falling stroke from the first transport portion 9 to the auger member 71, while removing a greater amount of paper dusts at the first transport portion 9.

Further, since the regulation wall 76 is higher than the contacting region between the first paper dust removing roller 9*b* and the first sponge member 9*c*, the regulation wall 76 can prevent the paper dusts fallen from the first transport portion 9 from being scattered toward the external side of the regulation wall 76, i.e., toward the paper dust accumulators 84 and remaining area of the front side bottom wall 64. Incidentally, the first transport portion 9 is in confrontation with the internal side of the regulation wall 76 defining the paper dust falling portion 83.

The paper dusts released from the first transport portion 9 are fallen onto the receiving surface 65 at a position below the auger member 71. In this case, the slant surface 67 guides the paper dusts toward the auger member 71, and the paper dusts can be involved into the auger member 71 rotating downwardly at a side confronting to the slant surface 67. Accordingly, the paper dusts can be smoothly directed toward the paper dust accumulators 84. After the paper dusts are transported to the paper dust accumulators 84, the paper dusts can be smoothly discharged from the auger member 71 into the paper dust accumulators 84 at the ridge portion 68 whose upper end is lower than the slant surface 67 and where the surface of the auger member 71 confronting the ridge portion 68 is moved upwardly.

As shown in FIG. 2, the lid member 85 is provided above the front side bottom wall 64 for covering the regulation wall 76. The lid member 85 is in a plate like shape and positioned below the bottom wall 63*d* of the partition plate 63. The lid member 85 extends between the front wall of the main casing 2 and a position adjacent to the extension portion 62*b* positioned above the first paper dust removing roller 9*b* and first sponge member 9*c*. A support portion 86 upstands from the front side bottom wall 64 for fixing the lid member 85 by a screw 87.

An opening 88 is provided between a rear side (a side of the sheet transport path 38) of the lid member 85 and the extension portion 62*b*. The opening extends in the axial direction of the first paper dust removing roller 9*b*. By covering the upper side of the regulation wall 76 with the lid member 85, scattering of the paper dusts fallen from the first transport portion 9 can be effectively eliminated.

Further, since the opening 88 is provided between the lid member 85 and the extension portion 62, the paper dusts released from the second transport portion 10 and the multiple purpose transport portion 16 those positioned above the lid member 85 can be introduced into the paper dust falling portion 83 and the paper dust accumulators 84 through the opening 88. After the paper dusts released from the second transport portion 10 and multiple purpose transport portion 16 are introduced into the paper dust falling portion 83, these paper dusts can be transported to the paper dust accumulators 84 by the auger member 71. Thus, effective paper dust removal can be provided.

Further, since the lid member 85 is positioned higher than the contact region between the first paper dust removing roller 9*b* and the first sponge member 9*c*, the paper dusts released from the first transport portion 9 cannot be easily scattered outwardly through the opening 88. Thus, more effective paper dust removal can be attained.

Further, in the laser printer 1, the paper dust accumulators 84 can be disposed on the front side bottom wall 64 since the paper dusts removed by the multiple purpose transport portion 16, second transport portion 10 and first transport portion 9 are transported toward axial ends of the auger member 71 through rotation thereof. Therefore, it is unnecessary to provide a paper dust accumulation space at a position lower than the front side bottom wall 64. To this effect, the auger member 71 is disposed above the attachment/detachment space of the sheet supply tray 6. As a result, attachment/detachment work of the sheet supply tray 6 can be performed easily while ensuring smooth removal of the paper dusts from the sheet 3 supplied from the sheet supply tray 6.

The laser printer 1 is of an electro-photographic type laser printer in which an electrostatic latent image is developed into a visible image which in turn transferred onto the sheet 3. Therefore, it is absolutely necessary to remove the paper dusts from the paper otherwise the paper dusts may be mingled into the image forming section 5 at the time of image transfer. In the present embodiment however, paper dusts can be efficiently removed from the sheet 3 by the first and second transport portions 9, 10 and the multiple purpose transport portion 16. Further, even if the first paper dust removing roller 9*b*, the second paper dust removing roller 10*b* and the multiple purpose paper dust removing roller 16*b* are rotated in the reverse direction for removing a jamming sheet, the paper dusts scraped by the first sponge member 9*c*, the second sponge member 10*c* and the multiple purpose sponge member 16*c* cannot be discharged into the sheet transport paths 38,38*a*. Therefore, adhesion of the paper dusts onto the subsequent sheet can be prevented. Thus, a desirable image can be formed on the subsequent sheet 3.

Further, in the laser printer 1, residual toner remaining on the surface of the photosensitive drum 23 after the image transferring operation is collected by the developing roller 27 with a cleaner-less system of the electro-photographic printing system using the non-magnetic single component type toners. If the paper dusts from the sheet 3 is adhered onto the surface of the photosensitive drum 23 at the time of image transfer operation, the paper dust may be collected together with the residual toner by the developing roller 27 and may be mixed with the toner in the developing cartridge 24, to thus degrade the output image. However, in the present embodiment, the paper dusts on the sheet 3 can be efficiently removed by the first and second transport portion 9, 10 and the multiple purpose transfer portion 16 in the image forming operation, and further, can be prevented the reversal transportation of the paper dusts into the sheet transport paths 38, 38*a*, the paper dusts having been scraped by the first sponge member 9*c*, second sponge member 10*c* and the multiple purpose sponge member 16*c* in spite of the reversal rotation of the first paper dust removing roller 9*b*, second paper dust removing roller 10*b* and multiple purpose paper dust removing roller 16*b* for removing the jamming sheet. Therefore, the subsequent sheet is not subjected to the adhesion of the paper dusts, and a desirable image can be formed while easily collecting the residual toner with the cleanerless system.

As described above, in the laser printer 1, the multiple purpose transport portion 16, the second transport portion 10, and the first transport portion 9 are arrayed substantially in the vertical direction and in front of the sheet transport path 38, and paper dusts removed by these portions 16, 10, 9 are respectively dropped because of their gravity through the chute 39 and are fallen onto the receiving portion 65. Thereafter, these paper dusts are congregately accumulated into the receiving portion 65. Accordingly, paper dusts removed at every multiple purpose transport portion 16, the second transport portion 10 and the first transport portion 9 can be guided with the simple arrangement and can be accumulated congregately. Thus, it is not necessary to provide each paper dust accumulator for each transport portion, which in turn simplifies the overall device, and can reduce numbers of mechanical components to provide a compact device.

Further, in the laser printer 1, since one side face of the guide plate 61 constituting the sheet transport path 38 can be utilized as the paper dust chute 39, which can also simplify the overall device, and can reduce numbers of mechanical components to provide a compact device.

Further, in the laser printer 1, since the first guide plate 61*a* is provided with the extension portion 62*a* covering the upper side of the second transport portion 10, and the second guide plate 61*b* is provided with the extension portion 62*b* covering the upper side of the first transport portion 9, the extension portion 62*a* prevents the paper dusts from falling onto the second transport portion 10, the paper dust being released from the multiple purpose transport portion 16 positioned above the second transport portion 10, and further, the extension portion 62*b* prevents the paper dusts from falling onto the first transport portion 9, the paper dust being released from the multiple purpose transport portion 16 as well as from the second transport portion 10 positioned above the first transport portion 9. Consequently, desirable paper dust removing operations in the first and second transport portions 9 and 10 can be attained for a long period.

Further, in the laser printer 1, the first paper dust removing roller 9*b* in the first transport portion 9 removes the paper dusts on the sheet 3 in rotational contact therewith, and then the paper dusts adhered onto the first paper dust removing roller 9*b* is scrapped off by the first sponge member 9*c* disposed opposite to the sheet transport path 38 with respect to the first paper dust removing roller 9*b*. Further, the second paper dust removing roller 10*b* in the second transport portion 10 removes the paper dusts on the sheet 3 in rotational contact therewith, and then the paper dusts adhered onto the second paper dust removing roller 10*b* is scrapped off by the second sponge member 10*c* disposed opposite to the sheet transport path 38 with respect to the second paper dust removing roller 10*b*. The paper dusts scraped by the first and second sponge members 9*c* and 10*c* are stayed thereon in confrontation with the sheet transport path 38 and are grown into paper dust masses, whereupon each paper dust mass is dropped because of its gravity along the paper dust chute 39. In this way, entry of the scrapped paper dusts into the sheet transport path 38 can be prevented, while the paper dusts removed by the first and second transport portions 9 and 10 can be congregately accumulated in the paper dust accumulators 84.

Further, the multiple purpose paper dust removing roller 16*b* in the multiple purpose transport portion 16 removes the paper dusts on the sheet 3 in rotational contact therewith, and then the paper dusts adhered onto the multiple purpose paper dust removing roller 16*b* is scrapped off by the multiple purpose sponge member 16*c* disposed opposite to the sheet transport path 38*a* with respect to the multiple purpose paper dust removing roller 16*b*. The paper dusts scraped by the multiple purpose sponge members 16*c* are dropped because of its gravity along the paper dust chute 39. In this way, entry of the scrapped paper dusts into the sheet transport path 38*a* can be prevented, while the paper dusts removed by the multiple purpose transport portions 16 can be congregately accumulated in the paper dust accumulator.

(5) Second Embodiment

An image forming device according to a second embodiment of the present invention will be described with reference to FIGS. 9 through 13(*b*) wherein like parts and components are designated by the same reference numerals and characters as those shown in the first embodiment shown in FIGS. 1 through 8. A laser printer 101 according to the second embodiment is different from the first embodiment in terms of the arrangement of collection of paper dusts.

Figure 9:
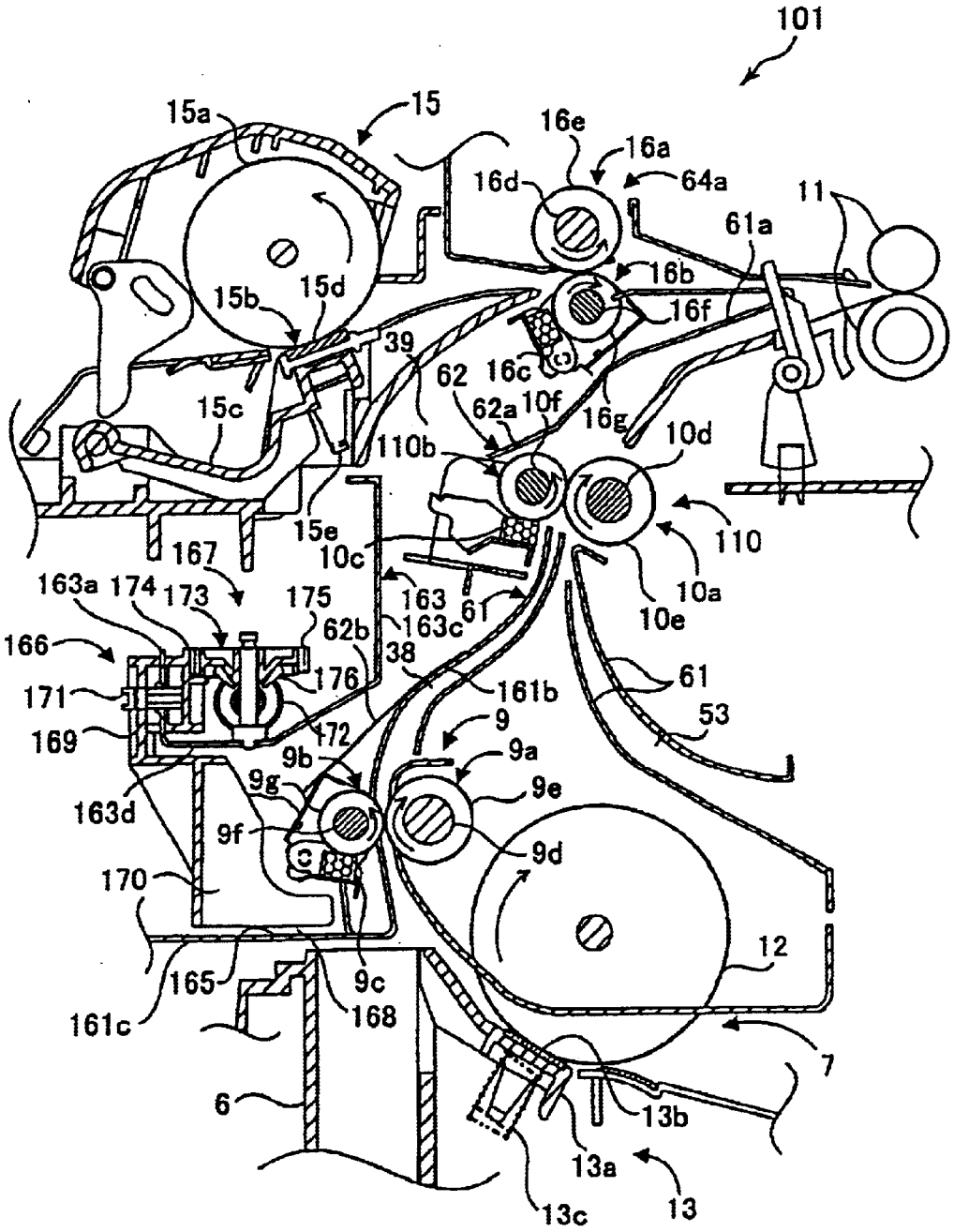
FIG. 9 is an enlarged cross-sectional view showing sheet transport path of a laser printer according to a second embodiment of the present invention.
Figure 10:
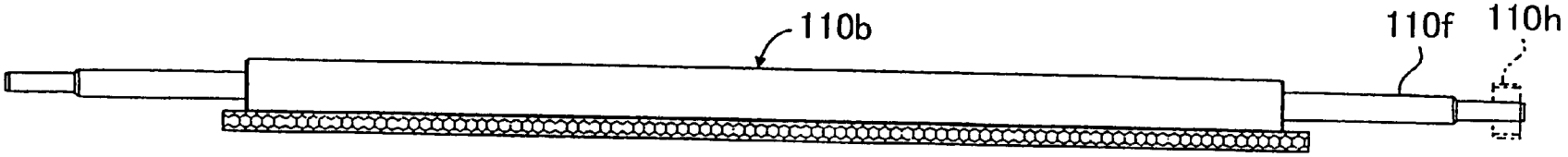
FIG. 10 is a cross-sectional view showing a second paper dust removing roller in the laser printer according to the second embodiment.

In a second transport portion 110, a second paper dust removing roller 110*b* is driven upon power input from a motor (not shown) into an input gear 110*h* as shown in FIG. 10, serving as power input means mounted on one end portion of the roller shaft 110*f*, so that the second paper dust removing roller 110*b* is rotatable in a direction indicated by an arrow in FIG. 9, that is, in the sheet feeding direction (counter clockwise direction in FIG. 9) at a region facing with the sheet transport path 38. The sheet 3 is nipped between the second transport roller 10*a* and the second paper dust removing roller 110*b* for feeding, while the paper dust is removed by the second paper dust removing roller 110*b*.

Regarding paper dust collecting arrangement, a lower end of a second guide plate 161*b* is integrally provided with a receiving plate 161*c* bent at substantially right angle from the second guide plate 161*b* toward frontward. The receiving plate 161*c* is positioned above an attachment/detachment path of the sheet supply tray 6 and extends in parallel therewith. An upper surface of the receiving plate 161*c* surves as a receiving surface 165 adapted for receiving paper dusts removed by and falling from the multiple purpose transport portion 16, the second transport portion 10 and the first transport portion 9.

A partition plate 163 is positioned in front of the second guide plate 161*b* with a predetermined space therefrom. The partition plate 163 includes a side plate 163*c* extending in a vertical direction and a bottom plate 163*d* bent at substantially right angle from a lower end of the side plate 163*c* toward frontward. Further, a plate-like fixing portion 163*a* bendingly extends upwardly from a front end of the bottom plate 163*d* for fixing a paper dust transport plate 166 and a transport drive portion 167 described later.

The laser printer 101 further provides a paper dust accumulators 168 for accumulating therein paper dusts falling onto the receiving surface 165 due to their gravity from the multiple purpose transport portion 16, the second transport portion 10 and the first transport portion 9. The printer 101 also provides the paper dust transport plate 166 for transporting paper dusts on the receiving surface 165 toward the paper dust accumulators 168, and the transport drive portion 167 for driving the paper dust transport plate 166.

Figure 12:
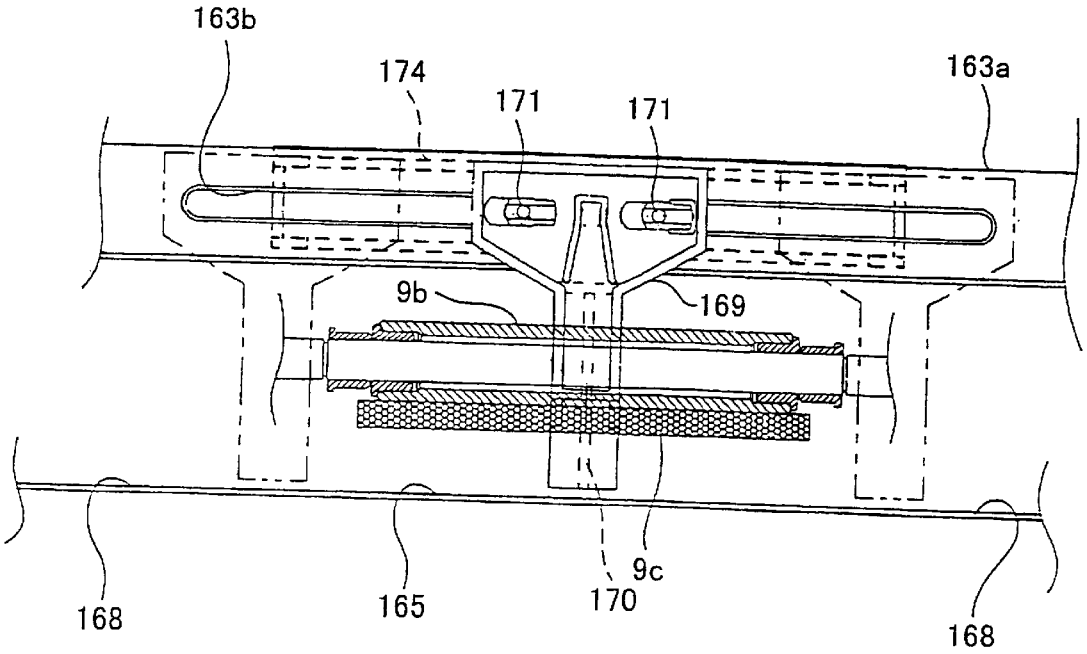
FIG. 12 is a front view showing the paper dust transport portion of the laser printer according to the second embodiment.

As shown in FIG. 12, the paper dust accumulators 168 are positioned below the multiple purpose transfer portion 16, the second transfer portion 10 and the first transfer portion 9. The paper dust accumulator 168 is provided at spaces located outward of the widthwise ends of the receiving surface 165, so that all paper dusts falling on the receiving surface 165 can be ultimately accumulated in the accumulators 168.

Figure 11:
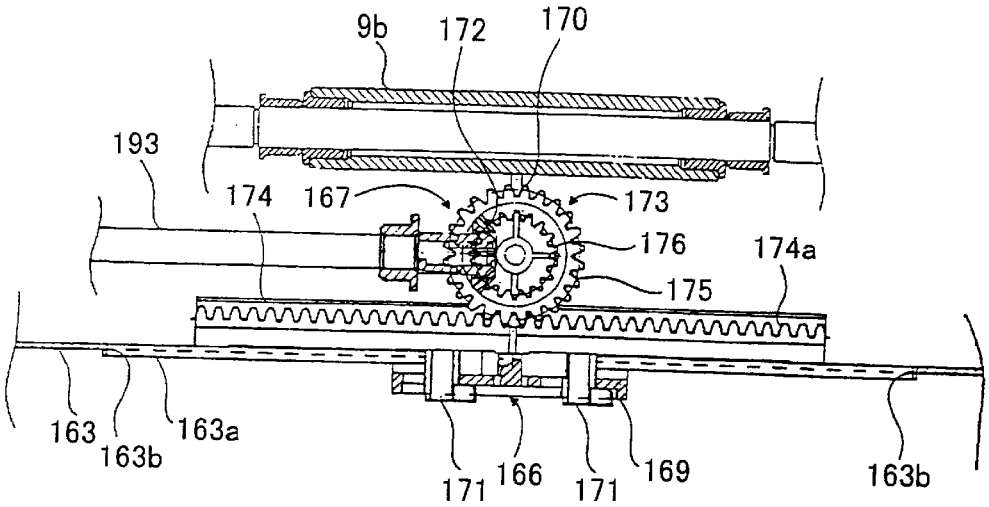
FIG. 11 is a cross-sectional view showing an essential portion of a paper dust transport portion and a transport drive portion in the laser printer according to the second embodiment.

The paper dust transport plate 166 is positioned above the sheet supply tray attachment/detachment path and above the receiving surface 165. The plate 166 includes a T-shaped plate like base portion 169 as viewed from the front as shown in FIG. 12 and a generally L-shaped thin plate-like wiper plate 170 as shown in FIG. 9 protruding rearwardly from and integrally with a widthwise center portion of the lower portion of the base portion 169 and extending downwardly to a position below the first transport portion 9. As shown in FIG. 11, the paper dust transport plate 166 has a T-shape in plan view in which the wiper plate 170 protrudes perpendicularly from the widthwise center portion of the base portion 169. The base portion 169 is fixed to a rack 174 of the transport drive portion 167 through screws 171 interposing the fixing portion 163*a* of the partition plate 163 between the paper dust transport plate 166 and the rack 174. The fixing portion 163*a* is formed with an elongated horizontally extending slot 163*b* through which the screws 171 extend. The paper dust transport plate 166 is reciprocally and horizontally movable along the horizontally extending slot 163*b* in accordance with the horizontal movement of the rack 174. A lower end of the wiper plate 170 is spaced away from the receiving surface 165 by a predetermined distance (about 2 mm) as shown in FIG. 9, so that the lower end is out of sliding contact from the receiving surface 165 during reciprocating movement of the wiper plate 170.

The transport drive portion 167 is disposed above the paper dust transport plate 166 and the paper dust accumulator 168 as shown in FIG. 9, and is separated from the first and second transport portions 9, 10 and the multiple purpose transport portion 16 by the partition plate 163. The transport drive portion 167 includes a power transmission mechanism 194 (see FIGS. 13(*a*) and 13(*b*)), a first bevel gear 172, a composite gear 173 and the rack 174.

The power transmission mechanism 194 is disposed along a side wall of the main casing 2, and includes an input gear 177, a conversion gear portion 178 and an output gear 179.

The input gear 177 is fixedly mounted on one end of an input shaft 180 drivingly rotated in one direction by a motor (not shown). The input gear 177 is meshedly engaged with a first conversion gear 181 of the conversion gear portion 178 described later.

The conversion gear portion 178 includes the first conversion gear 181, a second conversion gear 182, a pendulum member 183, and a third conversion gear 184. The first conversion gear 181 has a large diameter first outer gear 185 meshedly engaged with the input gear 177, and a small diameter first inner gear 186 concentrically integral with the first outer gear 185 and meshedly engaged with the second conversion gear 182.

The second conversion gear 182 has a gear teeth meshedly engaged with the first inner gear 186 of the first conversion gear 181. A cylindrical sleeve 187 extends from a wheel body of the second conversion gear 182 in an axial direction thereof at a position offset from the rotational center of the second conversion gear 182. The sleeve 187 is loosely engaged with a slot 188 formed in the pendulum member 183.

The pendulum member 183 is a plate member in a form of an elongated sector shape. The pendulum member 183 has a lower end formed with an arcuate teeth portion 189 meshedly engaged with a third inner gear 192 of the third conversion gear 184 described later. The slot 188 is formed in a longitudinal direction of the pendulum member 183 and at a width-wise center thereof. A pivot support 190 is provided between one end of the slot 188 and the arcuate teeth portion 189. Thus, the pendulum member 183 is pivotally movably supported by the pivot support 190, while the sleeve 187 of the second conversion gear 182 is loosely engaged with the slot 188.

The third conversion gear 184 has a large diameter third outer gear 191 meshedly engaged with the output gear 179, and a small diameter third inner gear 192 provided integrally and concentrically with the third outer gear 191 and meshedly engaged with the arcuate teeth portion 189 of the pendulum member 183.

The output gear 179 is fixedly mounted on one end portion of an output shaft 193 which transmits power to the first bevel gear 172. The output gear 179 is adapted for transmitting power from the third outer gear 191 of the third conversions gear 184 to the first bevel gear 172.

As shown in FIG. 11, the first bevel gear 172 is mounted on another end portion of the output shaft 193 which transmits power from the output gear 179. The first bevel gear 172 is meshedly engaged with a second bevel gear 176 of the composite gear 173 directing perpendicular to the first bevel gear 172.

As shown in FIG. 9, the composite gear 173 has a pinion gear 175 meshedly engaged with the rack 174 and the second bevel gear 176 provided integrally with the pinion gear 175 and positioned in radially inner side thereof. The pinion gear 175 is rotatable about a horizontal axis.

The rack 174 has a rack teeth 174*a* meshedly engaged with the pinion gear 175 of the composite gear 173. The rack 174 has an elongated rectangular shape whose longitudinal length is slightly greater than the width of the first paper dust removing roller 9*b*. The rack 174 extends in parallel with the axial direction of the first paper dust removing roller 9*b* in a state where the rack teeth 174*a* is meshedly engaged with the pinion gear 175. Upon rotation of the pinion gear 175, the rack 174 is linearly reciprocatingly moved in the axial direction of the first paper dust removing roller 9*b* while a rear surface of the rack 174 is in sliding contact with the fixing portion 163*a* of the partition plate 163 (FIG. 11).

Figures 13A, 13B:
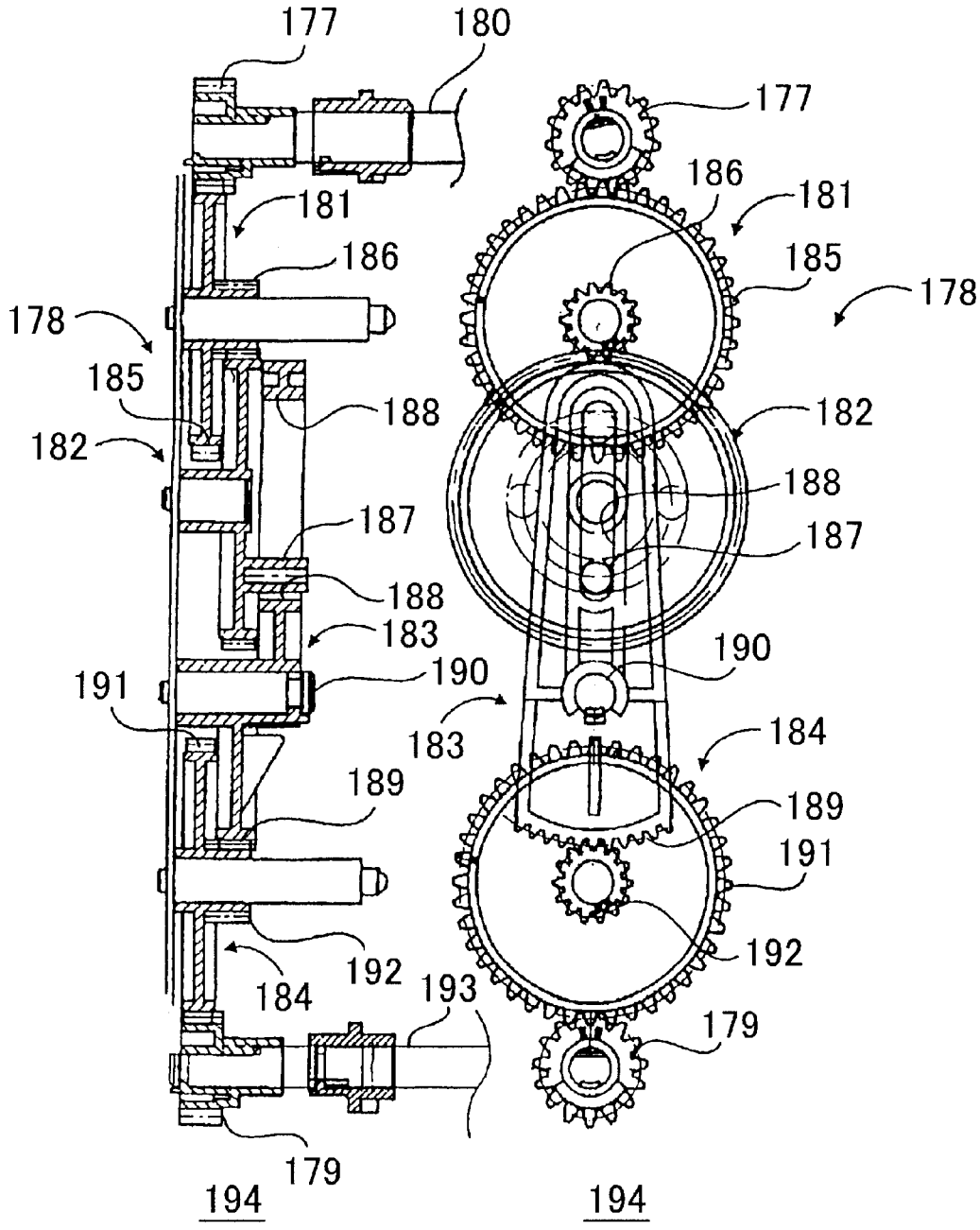
FIG. 13(*a*) is a cross-sectional view showing a power transmission mechanism of the laser printer according to the second embodiment.

In the transport drive portion 167 as shown in FIGS. 13(*a*) and 13(*b*), when the rotation of the motor (not shown) in one direction is transmitted to the input gear 177, the first outer gear 185 of the first conversion gear 181 meshedly engaged with the input gear 177 is rotated. Therefore, the second conversion gear 182 is rotated through the rotation of the first inner gear 186 of the first conversion gear 181, so that the sleeve 187 is circularly moved. Thus, the pendulum member 183 is laterally pivotally moved about the pivot support 190 because of the engagement between the sleeve 187 of the second conversion gear 182 and the slot 88 of the pendulum member 183, so as to reciprocally move the arcuate teeth portion 189. Accordingly, the rotating direction of the third inner gear 192 meshedly engaged with the arcuate teeth portion 189 is cyclically altered in both directions. Consequently, rotating direction of the output gear 179 is cyclically altered through the third outer gear 191.

As shown in FIG. 11, when this reciprocal rotation of the output shaft 193 is transmitted to the rack 174 through the first bevel gear 172, the second bevel gear 176 and the pinion gear 175, the rack 174 is reciprocally moved in the horizontal direction at a predetermined cycle. Therefore, as shown in FIG. 11, the paper dust transport plate 166 fixed to the rack 174 by the screws 171 can be horizontally displaced over the receiving surface 165 in the axial direction of the first paper dust removing roller 9*b* between stroke ends indicated by two dotted chain lines in FIG. 12. Each stroke end is positioned outwardly of each axial end of the first paper dust removing roller 9*b*. As a result, the wiper plate 170 can be driven to linearly reciprocatingly wipe the paper dusts dropped onto the receiving surface 165 and even at the position outwardly of the axial ends of the first paper dust removing roller 9*b*.

The transport drive portion 167 including the gear transmission from the input gear 177 to the output gear 179 provides speed deceleration in such a manner that the reciprocal moving speed of the paper dust transport plate 166 is not more than 100 mm/sec.

In the laser printer 101, the transport drive portion 167 is disposed above the paper dust transport plate 166 and the paper dust accumulator 168, and is isolated by the partition plate 163. Therefore, the partition plate 163 can effectively prevent paper dust from entering into the transport drive portion 167, the paper dust being released from the multiple purpose transport portion 16, the second transport portion 10 and the first transport portion 9 due to gravity, or transported by the paper dust transport plate 166, or the accumulated in the accumulator 168. As a result, operational malfunction of the transport drive portion 167 due to entry of the paper dust can be eliminated, to provide a stabilized operation thereof, thereby providing sufficient paper dust removing operation for a long duration of time.

Further, in the laser printer 101, the paper dust is wiped by the wiper 170 of the paper dust transport plate 166, the wiper being reciprocatingly moved in the horizontal direction, and is transported to the paper dust accumulators 168. Therefore, stabilized transportion of the paper dusts is achievable with a simple arrangement without any complicated transportation mechanism.

Further, the wiper 170 is linearly reciprocatingly moved along the axial direction of the first paper dust removing roller 9*b*. Therefore, desirable transportation of the paper dusts toward the accumulator 168 can be attained without any residual paper dusts on the receiving surface 165 with a minimized space and simplified arrangement.

Assuming that the wiper 170 is not a linear reciprocation type but a pivotally moving reciprocation type. In the latter case, in order to reduce a non-wiped out area, large pivotally moving locus is required, which in turn makes the entire device bulky. In order to avoid bulky arrangement without enlargement of the pivotal moving region, a flexible blade member may be used which may be deformed or flexed in contacting with an opponent component. However, a complicated arrangement is required for assembling the flexible blade and number of mechanical components may be increased.

In contrast, if the wiper 170 is provided linearly reciprocatingly movable in the axial direction of the first paper dust removing roller 9*b* as in the second embodiment, simple arrangement results with a minimized space capable of providing a desirable transportation of the paper dusts into the accumulator 168 without non-wiped out area.

Further, since the paper dust transport plate 166 is moved at a low speed such as not more than 100 mm/sec., the paper dusts on the receiving surface 165 can be transported to the accumulator 168 without any scattering of the paper dust. Accordingly, entry of the paper dust into the transport drive portion 167 can further be avoided, to attain desirable paper dust removing operation for a long duration of time.

Further, since the wiper 170 is spaced away from the receiving surface 165 by the predetermined gap (about 2 mm) while the wiper is reciprocatingly moved in the horizontal direction, frictional contact of the wiper 170 agaist the receiving surface 165 can be eliminated, to avoid damage to the wiper. Thus, enhanced durability of the paper dust transport plate 166 results for providing efficient transportation of the paper dust. Incidentally, since the paper dusts falling onto the receiving surface 165 is not a fine particle but in the form of a mass, the paper dusts can still be wiped by the wiper 170 regardless of the predetermined gap. The gap does not affect the transportation of the paper dusts mass.

Further, in the laser printer 101, since paper dusts removed by the multiple purpose transport portion 16, the second transport portion 10 and the first transport portion 9 are accumulated, by the transportation of the paper dust transport plate 166, into the paper dust accumulators 168 positioned at the widthwise ends of the receiving surface 165, it is not necessary to provide an accumulation space at a position immediately below the receiving surface 65. Consequently, the paper dust transport plate 166 can be positioned above the attachment/detachment path of the sheet supply tray 6, yet performing efficient paper dust removal from the sheet supplied from the sheet supply tray 6, while ensuring smooth attachment/detachment of the sheet supply tray 6.

Further, in the laser printer 101, driving force in one direction input into the input gear 177 can be converted into the driving force in reciprocating direction through the conversion gear portion 178 in the power transmission mechanism 194, and thereafter, the reciprocally driving force is output to the paper dust transport plate 166 through the output gear 179. In this way, one directional driving force can be converted into reciprocating directional driving force with the simple arrangement, to provide reciprocal motion of the paper dust transport plate 166.

While the invention has been described in detail and with reference to the specific embodiments thereof, it would be apparent to those skilled in the art that various changes and modifications may be made therein without departing from the spirit and scope of the invention.

For example, in the above-described embodiments, only one first transport portion 9 and only one second transport portion 10 are provided. However, a plurality of first transport portions and a plurality of second transport portions can be provided. Alternatively, a plurality of transport portions can be provided for one of the first and second transport portions.

Further, in the depicted embodiments, the first transport portion 9 provided with the first paper dust removing roller 9*b* is provided upstream of the second transport portion 10 provided with the second paper dust removing roller 10*b*. However, the second transport portion 10 provided with the second paper dust removing portion 10*b* can be disposed upstream of the first transport portion 9 provided with the first paper dust removing roller 9*b*. In the latter case, since the area of the paper dusts generated by the friction against the pad member 13 will slightly expand in the widthwise direction of the sheet 3 due to the contact with the second paper dust removing roller 10*b*, the width of the first paper dust removing roller 9*a* and the width of the first sponge member 9*c* should desirably be greater than the widths thereof in case of the arrangement where the first transport portion 9 is provided upstream of the second transport portion 10.

Further, in the above described embodiment, a center register type is applied for the sheet feeding from the sheet supply section 7 to the first transport portion 9, and the auger member 71 is adapted to transport paper dusts toward both axial ends thereof. Instead of this arrangement, a side register type can be applied and the auger member 71 can be adapted for transporting the paper dusts to one side only, the one side being opposite to the sheet register portion.

Further, in the first embodiment, the rotating direction of the auger 71 is such that the surface of the auger member 71 is moved downwardly at a side facing the first transport portion 9. However, if the distance between the auger receiving portion of the receiving surface 65 and the first transport portion 9 is sufficiently long in the horizontal direction, the rotating direction of the shaft member 72 of the auger member 71 is not restrictive, but the surface of the auger member can be moved upwardly at a side facing the first transport portion 9.

Further, in the first embodiment, the second partition wall 79 of the regulation wall 76 includes the center wall 80 extending in parallel with the auger member 71 with a predetermined space therefrom, the one side slant wall 81 and the other side slant wall 82 extending from the ends of the center wall 80 toward the auger member 71 by bending at the ends of the center wall. These walls are integrally with each other. However, the second partition wall is not limited to the above-described configuration. For example, a plurality of walls can be used to make a center wall with a slit between the neighboring walls. Alternatively, an opening or a notch can be formed at a longitudinally intermediate portion of the second partition wall 79.

Further, in the above-described embodiments, the first reverse transportation preventive member 9*m*, the second reverse transportation preventive member 10*m*, and the multiple purpose reverse transportation preventive member 16*m* are positioned spaced away from the corresponding first paper dust removing roller 9*b*, second paper dust removing roller 10*b*, and multiple purpose paper dust removing roller 16*b*, respectively. However, these preventive members 9*m*, 10*m*, 16*m* can be contacted with the corresponding rollers by constituting these preventive members by brushes, films and unwoven fabrics those allowing the paper dusts to be transported during the normal rotation of the paper dust removing rollers 9*b*, 10*b*, 16*b*, but preventing the paper dusts from passing therethrough during reversal rotation of these rollers.

Figure 14:
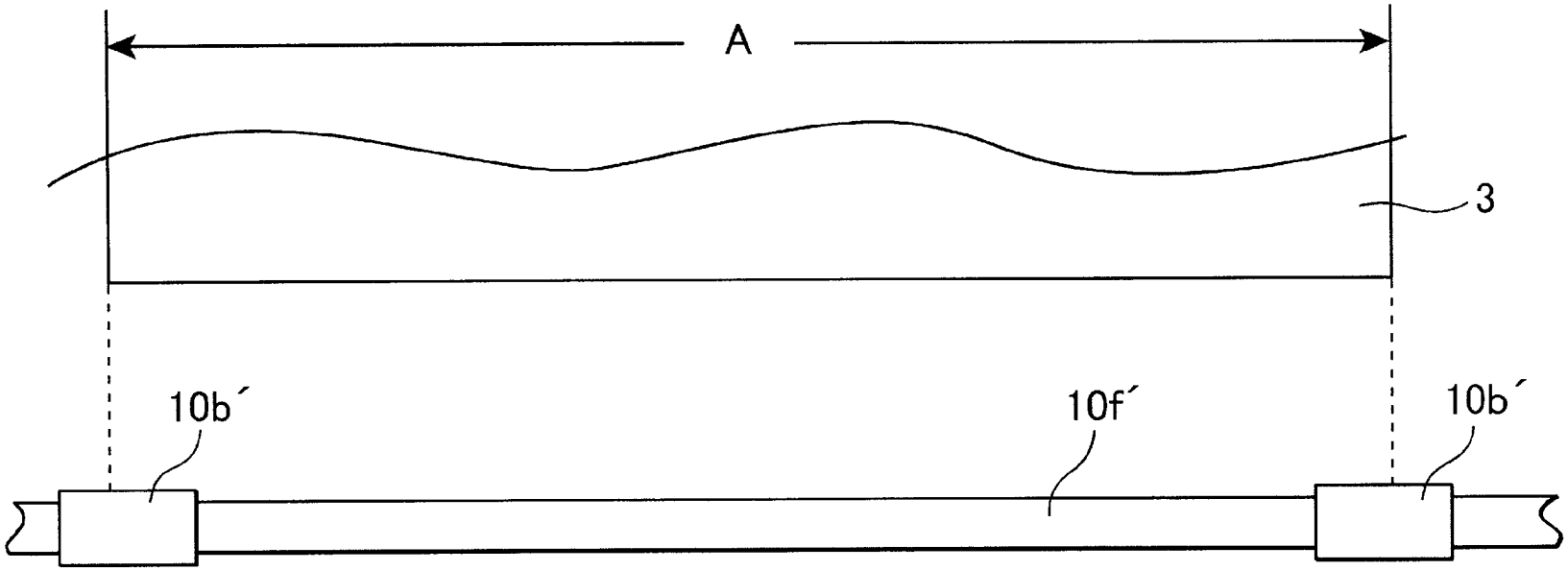
FIG. 14 is a schematic view showing a relationship between a pair of second paper dust removing rollers and the image recording medium according to a modified embodiment of the present invention.

Further, in the above described embodiments, the second paper dust removing roller 10*b*, 110*b* has a width perpendicular to the sheet feeding direction greater than the width of the sheet 3 for removing the paper dusts from overall surface of the sheet 3. However, paper dusts generated upon sheet cutting is particularly located adjacent to the cutting edge, i.e., widthwise edge potions of the sheet 3. Therefore, as shown in FIG. 14, two second paper dust removing roller 10*b*' are provided on a roller shaft 10*f*' at positions corresponding to the widthwise edge portions of the sheet 3 for removing the paper dust from the sheet 3 at least in areas corresponding to the widthwise edge portions of the sheet 3.

Further, the present invention is particularly available for the sheet supply section 7 in which sheet separation is achieved by making use of a friction, which easily provides paper dusts. However, the present invention is also available for another sheet separation systems other than frictional separation, such as a system using pawls or a system using a bank.

What is claimed is:

1. An image forming device for forming an image on an image recording medium, the device comprising:

a sheet supply section comprising a sheet supply roller and a separation pad for nippingly supplying each image recording medium therebetween;

an image forming section for forming an image on the image recording medium supplied from the sheet supply section;

a sheet transport path extending from the sheet supply section to the image forming section and defining a sheet feeding direction; and at least two paper dust removing units comprising a first paper dust removing unit disposed at a position beside the sheet transport path and contactable with the image recording medium for removing paper dusts from the image recording medium running in the sheet transport path toward the image forming section, and a second paper dust removing unit disposed at a position beside the sheet transport path and different from the position of the first paper dust removing unit with respect to the sheet feeding direction and also contactable with the image recording medium for also removing paper dusts from the image recording medium running in the sheet transport path toward the image forming section;

wherein:

the image recording medium and the separation pad have each width perpendicular to the sheet feeding direction;

the first paper dust removing unit has an area for removing the paper dusts from the image recording medium at least in an area corresponding to the width of the separation pad; and the second paper dust removing unit has an area for removing the paper dusts from overall surface of the image recording medium.

2. The image forming device as claimed in claim 1, wherein the first paper dust removing unit comprises a first paper dust removing member in contact with the image recording medium during its travel in the sheet transport path; and wherein the second paper dust removing unit comprises a second paper dust removing member in contact with the image recording medium during its travel in the sheet transport path.

3. The image forming device is claimed in claim 2, wherein the sheet supply section further comprises a sheet supply tray on which a plurality of image recording mediums are stacked as a sheet stack, the sheet supply roller and the separation pad separating an uppermost sheet from the sheet stack and supplying the uppermost sheet toward the image forming section; and wherein the first paper dust removing member and the second paper dust removing member are disposed downstream of the sheet supply roller in the sheet feeding direction and out of contact from the sheet supply roller.

4. The image forming device as claimed in claim 2, wherein the first paper dust removing unit further comprises a first scraping member disposed in confrontation with the first paper dust removing member for scraping off the paper dusts adhered to the first paper dust removing member; and, wherein the second paper dust removing unit further comprises a second scraping member disposed in confrontation with the second paper dust removing member for scraping off the paper dusts adhered to the second paper dust removing member.

5. The image forming device as claimed in claim 4, wherein the first and second paper dust removing members have regions confronting the sheet transport path, the regions being movable in the sheet feeding direction; and wherein the first and second scraping members are disposed at positions opposite to the sheet transport path with respect to the first and second paper dust removing members respectively and below the first and second paper dust removing members respectively.

6. The image forming device as claimed in claim 5, wherein the first paper dust removing member and the second paper dust removing member are rotatable in a normal rotating direction that is the sheet feeding direction as well as in a reverse rotating direction opposite to the sheet feed direction; and wherein the first paper dust removing unit further comprises a first reverse transport preventive member disposed between a first contact position between the first paper dust removing member and the image recording medium and a second contact position between the first paper dust removing member and the first scraping member for preventing the paper dusts released from the first scraping member from being transported toward the sheet transport path during the reverse rotation of the first paper dust removing member.

7. The image forming device as claimed in claim 6, wherein the second paper dust removing unit further comprises a second reverse transport preventive member disposed between a first contact position between the second paper dust removing member and the image recording medium and a second contact position between the second paper dust removing member and the second scraping member for preventing the paper dusts released from the second scraping member from being transported toward the sheet transport path during the reverse rotation of the second paper dust removing member.

8. The image forming device as claimed in claim 2, further comprising:

a first transport roller disposed in confrontation with the first paper dust removing member for transporting the image recording medium in nipping relation with the first paper dust removing member; and a second transport roller disposed in confrontation with the second paper dust removing member for transporting the image recording medium in nipping relation with the second paper dust removing member.

9. The image forming device as claimed in claim 2, further comprising a sheet re-circulation section including a sheet re-circulation path and a sheet reversing region disposed at the sheet re-circulation path, the sheet recirculation path having an upstream end connected to the image forming section for receiving the image recording medium, whose one surface has been formed with an image, discharged from the image forming section and delivering the image recording medium to the sheet reversing region, and an downstream end joined to the sheet transport path at a joint portion upstream of the image forming section for feeding the image recording medium from the sheet reversing region to the image forming section to form another image on another surface of the image recording medium, the first paper dust removing member being positioned upstream of the joint portion, and the second paper dust removing member being positioned downstream of the joint portion.

10. The image forming device as claimed in claim 2, wherein the image recording medium and the separation pad have each width perpendicular to the sheet feeding direction and, wherein the first paper dust removing member has an area for removing the paper dust from the image recording medium at least in an area corresponding to the width of the separation pad, and wherein the second paper dust removing member has an area for removing the paper dust from the image recording medium at least in areas corresponding to widthwise edge portions of the image recording medium.

11. The image forming device as claimed in claim 1, wherein the second paper dust removing unit has a width perpendicular to the sheet feeding direction greater than the width of the image recording medium.

12. The image forming device as claimed in claim 1, wherein the first paper dust removing member has a width perpendicular to the sheet feeding direction greater than the width of the separation pad and smaller than the width of the image recording medium.

13. The image forming device as claimed in claim 1, wherein the second paper dust removing unit is disposed downstream of the first paper dust removing unit in the sheet feeding direction.

14. The image forming device as claimed in claim 1, wherein the width of the first paper dust removing unit is smaller than the width of the second paper dust removing unit.

15. The image forming device as claimed in claim 1, further comprising a drive force input member connected to at least the second paper dust removing unit for drivingly rotating the second paper dust removing unit.

16. The image forming device as claimed in claim 1, wherein the at least two paper dust removing units are arrayed in a substantially vertical direction at one side of the sheet transport path.

17. The image forming device as claimed in claim 1, wherein the image forming section comprises an electrophotographic system components in which a visible image upon development of an electrostatic latent image is transferred onto the image recording medium.

18. The image forming device as claimed in claim 17, wherein the image forming section comprises:

a photosensitive drum on which the electrostatic latent image is formed; and a developing device supplying a developing agent to the photosensitive drum, the development agent comprising non-magnetic single component type agents; the developing device also collecting residual developing agent remaining on the photosensitive drum after transferring image from the photosensitive drum to the image recording medium.

19. An image forming device comprising:

an image forming section for forming an image on an image recording medium;

a sheet transport path extending to the image forming section, the image recording medium being passed through the sheet transport path in a sheet feeding direction;

a paper dust removing member positioned in confrontation with the sheet transport path and contactable with the image recording medium passing therethrough for removing paper dusts from the image recording medium;

a scraping member in contact with the paper dust removing member for scraping off the paper dusts from the paper dust removing member, the paper dust removing member being supported rotatably in a normal direction equivalent to the sheet feeding direction and a reverse direction opposite to the normal direction; and a reverse transport preventive member disposed between a first contact position defined between the paper dust removing member and the image recording medium and a second contact position defined between the paper dust removing member and the scraping member for preventing the paper dusts released from the scraping member from being transported back toward the sheet transport path during the reverse rotation of the paper dust removing member.

20. The image forming device as claimed in claim 19, wherein the reverse transport preventive member and the paper dust removing member provide a gap therebetween, the gap providing a dimension allowing the paper dusts to pass therethrough during the normal rotation of the paper dust removing member, but preventing the paper dusts to pass therethrough during the reverse rotation of the paper dust removing member.

21. The image forming device as claimed in claim 20, wherein the gap has a length ranging from 0.2 to 2 mm.

22. The image forming device as claimed in claim 19, wherein the reverse transport preventive member has a tip end portion having an orientation, an intersection angle being defined between a tangential line and an extension line which is the orientation of the tip end portion, the tangential line being on the paper dust removing member with respect to a line connecting between a tip end of the tip end portion and a rotational center of the paper dust removing member, and the intersection angle being not more than 90 degrees.

23. The image forming device as claimed in claim 22, wherein the tip end portion is disposed upstream of the line connecting between the tip end of the tip end portion and the rotational center of the paper dust removing member in the normal rotating direction of the paper dust removing member.

24. The image forming device as claimed in claim 22, wherein the tip end portion of the reverse transport preventive member is oriented for providing direct confrontation with the paper dusts transported on the paper dust removing member during the reverse rotation thereof.

25. The image forming device as claimed in claim 19, wherein the reverse transport preventive member has a width extending in a direction perpendicular to the sheet feed direction greater than a width of the paper dust removing member.

26. The image forming device as claimed in claim 19, wherein the reverse transport preventive member has a width extending in a direction perpendicular to the sheet feed direction greater than a width of the scraping member.

27. The image forming device as claimed in claim 19, further comprising a casing supporting the paper dust removing member and the scraping member, the reverse transport preventive member being provided integrally with the casing.

28. The image forming device as claimed in claim 19, wherein the reverse transport preventive member has one side confronting the paper dust removing member and another side serving as a guide member for guiding the paper dusts downwardly, the paper dusts being fallen onto the reverse transport preventive member.

29. The image forming device as claimed in claim 19, further comprising a transport member in contact with the paper dust removing member for transporting the image recording medium along the transport path.

30. An image forming device comprising:

an image forming section for forming an image on an image recording medium;

a first paper dust removing unit for removing paper dusts from the image recording medium to be supplied to the image forming section;

a paper dust transport unit disposed lower than the first paper dust removing unit for transporting in a paper dust transporting direction the paper dusts falling down from the first paper dust removing unit;

a regulation wall disposed at a part of the paper dust transport unit for regulating a flow of the paper dusts; and a paper dust deposit region disposed lower than the first paper dust removing unit, and a paper dust accumulating section positioned beside the paper dust deposit region in the widthwise direction of the image recording medium; and wherein the regulation wall comprises a wall section which separates the paper dust deposit region from the paper dust accumulating section, the paper dust deposit region receiving paper dusts falling down from the first paper dust removing unit, and the paper dust accumulating section accumulating therein the paper dusts transported by the paper dust transport unit from the paper dust deposit region, the wall section having a shape and dimension allowing the paper dusts to be fed from the paper dust deposit region to the paper dust accumulating section during the transportation of the paper dusts by the paper dust transport unit, but preventing the paper dusts from being moved from the paper dust accumulating section to the paper dust deposit region.

31. The image forming device as claimed in claim 30, wherein the paper dust transport unit comprises a rotatable spiral feed member having a rotation axis, the paper dusts being transported in a direction of the rotation axis through the rotation of the spiral feed member.

32. The image forming device as claimed in claim 31, wherein the rotatable spiral feed member comprises:

a rotation shaft rotatable about its axis and having an intermediate portion and end portions;

a first spiral member having a first spiral direction and formed over a right half of the rotation shaft; and a second spiral member having a second spiral direction opposite to the first spiral direction and formed over a left half of the rotation shaft, whereby the paper dusts are transported toward both axial ends of the rotation shaft.

33. The image forming device as claimed in claim 32, wherein the paper dust deposit region is located at the intermediate portion of the rotation shaft, and the paper dust accumulating section includes two paper dust accumulating zones located adjacent the axial end portions of the rotation shaft.

34. The image forming device as claimed in claim 31, wherein the rotatable spiral feed member has a confronting region in confrontation with the first paper dust removing unit, the confronting region being moved downwardly by the rotation of the spiral feed member.

35. The image forming device as claimed in claim 34, further comprising a paper dust receiving portion including the paper dust deposit region, the paper dust receiving portion being positioned below the paper dust transport unit, the paper dust receiving portion including a longitudinally extending recessed portion in which the paper dust transport unit is positioned, a slant surface at one longitudinally extending side of the recessed portion and confronting one longitudinally extending side of the feed member, and a ridge portion opposite to the slant surface with respect to the feed member, the feed member having one longitudinally extending side movable downwardly facing the slang surface, and the feed member having another longitudinally extending side movable upwardly facing the ridge portion, the ridge member having a height lower than the slant surface.

36. The image forming device as claimed in claim 35, further comprising a sheet supply section for supplying the image recording medium to the image forming section, and wherein the first paper dust removing unit is disposed to first contact with the image recording medium after the medium is supplied from the sheet supply section.

37. The image forming device as claimed in claim 30, wherein the regulation wall comprises:

a first partition wall partitioning the paper dust transport unit in a direction intersecting therewith, and a second partition wall connected to the first partition wall and positioned with a space from the paper dust transport unit, the second partition wall providing the space from the paper dust transport unit gradually narrower toward the paper dust transporting direction.

38. The image forming device as claimed in claim 30, wherein the first paper dust removing unit comprises:

a paper dust removing member rotatable and contactable with the image recording medium; and a scraping member in contact with the paper dust removing member for scraping off the paper dusts from the paper dust removing member.

39. The image forming device as claimed in claim 38, wherein the paper dust transport unit provides a rotation speed lower than a rotation speed of the paper dust removing member.

40. The image forming device as claimed in claim 39, further comprising a second paper dust removing unit disposed at a position upper than the regulation wall and at a position different from that first paper dust removing unit in the sheet feed direction for removing the paper dusts from the image recording medium to be supplied to the image forming section.

41. The image forming device as claimed in claim 40, wherein the lid member is formed with an opening through which paper dusts falling from the second paper dust removing unit pass into an interior space of the regulation wall.

42. The image forming device as claimed in claim 41, wherein the opening is positioned higher than the contact portion between the paper dust removing member and the scraping member of the first paper dust removing unit.

43. The image form device as claimed in claim 42, further comprising a tray detachably provided with respect to a main casing for stacking a plurality of image recording mediums thereon, the main casing being formed with an attachment/detachment path for the tray, and the paper dust transport unit being disposed above the attachment/detachment path.

44. The image forming device as claimed in claim 38, wherein the paper dust removing member and the scraping member provide a contact portion therebetween, the regulation wall having an upper end higher than the contact portion.

45. The image forming device as claimed in claim 38, further comprising a lid member covering an upper space of the regulation wall.

46. An image forming device for forming an image on an image recording medium, the device comprising:

a sheet supply section comprising a sheet supply roller and a separation pad for nippingly supplying each image recording medium therebetween;

an image forming section for forming an image on the image recording medium supplied from the sheet supply section;

a sheet transport path extending from the sheet supply section to the image forming section and defining a sheet feeding direction;

at least two paper dust removing units comprising a first paper dust removing unit disposed at a position beside the sheet transport path and contactable with the image recording medium for removing paper dusts from the image recording medium running in the sheet transport path toward the image forming section, and a second paper dust removing unit disposed at a position beside the sheet transport path and different from the position of the first paper dust removing unit with respect to the sheet feeding direction and also contactable with the image recording medium for also removing paper dusts from the image recording medium running in the sheet transport path toward the image forming section; and a paper dust accumulating section for congregately accumulating therein paper dusts removed by at least two paper dust removing units from the image recording medium and then released from the respective paper dust removing units.

47. The image forming device as claimed in claim 46, wherein the paper dust accumulating section is disposed at a position lower than the at least two paper dust removing units for receiving therein the paper dusts released from the respective paper dust removing units and fallen downwardly due to gravity of the paper dusts.

48. The image forming device as claimed in claim 47, further comprising a paper dust deposit region positioned lower than the at least two paper dust removing units.

49. The image forming device as claimed in claim 48, further comprising a paper dust transport unit disposed adjacent to the paper dust deposit region for transporting the paper dusts deposited on the paper dust deposit region toward the paper dust accumulating section.

50. The image forming device as claimed in claim 49, wherein the paper dust accumulating section is located at each side of the paper dust deposit region in the widthwise direction of the image recording medium to function as a paper dust accumulating pair, and wherein the paper dust transport unit comprises a wiper plate reciprocally movable in the widthwise direction of the image recording medium over the paper dust deposit region and partly over the paper dust accumulating pair.

51. The image forming device as claimed in claim 49, wherein the paper dust accumulating section is located at each side of the paper dust deposit region in the widthwise direction of the image recording medium to function as a paper dust accumulating pair, and wherein the paper dust transport unit comprises an auger member extending in the widthwise direction of the image recording medium over the paper dust deposit region and partly over the paper dust accumulating pair, the auger member being rotatable about its axis.

52. The image forming device as claimed in claim 49, further comprising a regulation wall component disposed to intersect with the paper dust transport unit, the regulation wall component separating the paper dust deposit region from the paper dust accumulating section.

53. The image forming device as claimed in claim 48, further comprising a paper dust chute for guiding downwardly falling travel of the paper dusts and for directing the paper dusts toward the paper dust deposit region.

54. The image forming device as claimed in claim 53, wherein the sheet transport path comprises a guide plate having one surface guiding a travel of the image recording medium; and wherein the guide plate has an opposite surface serving as the paper dust chute.

55. The image forming device as claimed in claim 54, wherein the guide plate is provided with a first extension plate disposed immediately above the first paper dust removing unit and with a second extension plate disposed immediately above the second paper dust removing unit.

56. The image forming device as claimed in claim 46, wherein the at least two paper dust removing units are arrayed in a substantially vertical direction at one side of the sheet transport path.

57. The image forming device as claimed in claim 46, wherein the image forming section comprises an electrophotographic system components in which a visible image upon development of an electrostatic latent image is transferred onto the image recording medium.

58. The image forming device as claimed in claim 57, wherein the image forming section comprises:

a photosensitive drum on which the electrostatic latent image is formed; and a developing device supplying a developing agent to the photosensitive drum, the development agent comprising non-magnetic single component type agents; the developing device also collecting residual developing agent remaining on the photosensitive drum after transferring image from the photosensitive drum to the image recording medium.

* * * * *